US007217439B2

(12) United States Patent
Sugino

(10) Patent No.: US 7,217,439 B2
(45) Date of Patent: May 15, 2007

(54) CREATION METHOD OF DYED DRAWING OF PLANT MATTER

(76) Inventor: Nobuo Sugino, c/o Oshibana Art Co., Ltd., 7th Floor, 2-5-10 Takashima, Nishi-ku, Yokohama, Kanagawa (JP)

( * ) Notice: Subject to any disclaimer, the term of this patent is extended or adjusted under 35 U.S.C. 154(b) by 381 days.

(21) Appl. No.: 10/736,186

(22) Filed: Dec. 15, 2003

(65) Prior Publication Data

US 2005/0129837 A1 Jun. 16, 2005

(51) Int. Cl.
*B05D 1/28* (2006.01)

(52) U.S. Cl. ..... 427/11; 427/258; 427/261; 427/288; 427/428.01

(58) Field of Classification Search ..... 427/11, 427/258, 261, 288, 428.01
See application file for complete search history.

(56) References Cited

U.S. PATENT DOCUMENTS 2,285,599 A * 6/1942 Mauro ..... 427/288

FOREIGN PATENT DOCUMENTS

JP 03-268943 * 11/1991
JP 11-269002 * 10/1999

OTHER PUBLICATIONS

The Art and Craft of Pounding Flowers, Laura C. Martin, pp. 10-19, 23-29, 2001.*

* cited by examiner

*Primary Examiner*—Fred J. Parker
(74) *Attorney, Agent, or Firm*—Jordan and Hamburg LLP

(57) ABSTRACT

The creation method of a dyed drawing includes a step of arranging of a mesh sheet on the surface of the canvas for the dyed drawing, arranging leaves and flowers on the upper surface of a mesh sheet, covering the plant matter with a synthetic resin sheet, creating the dyed drawing on the canvas including pushing the leaves and flowers to the mesh sheet after pressing the synthetic resin sheet with a spatula etc., the pigment of the leaves and flowers outflowing and being adhered to the canvas, and removing the mesh sheet, the leaves and flowers and the synthetic resin sheet which are located on the surface of the canvas for the dyed drawing so the dyed drawing can be created, adhering and transferring the pigment of leaves and flowers of the plant matter to the drawing paper, canvas, etc.

11 Claims, 48 Drawing Sheets

CREATION METHOD OF DYED DRAWING OF PLANT MATTER

BACKGROUND OF THE INVENTION

This invention relates to a method for creating a dyed drawing with plant matter by adhering the pigment of leaves and flowers of the plant matter to drawing paper, canvas, etc.

In the conventional dyed drawing, the leaves and flowers are located on the cloth such as cotton and hemp, and the leaves and flowers are struck by a hammer. Then, the pigment of the leaves and flowers is adhered to the cloth.

In the conventional dyed drawing, the leaves and flowers are struck with a hammer, and the pigment of the leaves and flowers is transferred to the cloth such as cotton and hemp. Therefore, it is difficult to transfer pigment from the the leaves and flowers, and it is too hard to create a beautiful dyed drawing.

Moreover, it is possible to create the drawing to only the cloth which has an uneven surface thereof such as cotton and hemp.

SUMMARY OF THE INVENTION

Accordingly, it is an object of the invention to provide a method of creating a dyed drawing of plant matter by adhering the pigment of leaves and flowers to drawing paper, canvas, etc. It is another object of the invention to provide a method to create a dyed drawing of plant matter that everyone can do easily, and it can be introduced as a subject of a culture classroom.

Novel features which are believed to be characteristic of the invention, both as to its organization and method of operation, together with further objects and advantages thereof, are described below with reference to the accompanying drawings in which preferred embodiments of the invention are illustrated as examples.

It is to be expressly understood, however, that the drawings are for the purpose of illustration and description only, and are not intended as a definition of the limits of the invention.

DETAILED DESCRIPTION

Preferred embodiments of the present invention are described in more detail below with reference to the accompanying drawings.

FIGS. 1–9 illustrate a transfer method and an adhesive for transfer in accordance with a first embodiment of the present invention.

The numeral 1 shows a step for arranging a mesh sheet, and the mesh sheet is arranged at a surface of a canvas on which the dyed drawing is drawn, the canvas 2 including a drawing paper, cloth, and canvas which can absorb the plant matter for the dyed drawing. The canvas 2 for the dyed drawing of the plant used in the arrangement step 1 of the mesh sheet is used as it is if it has an adequate water absorption rate. On the other hand, if the water absorption rate is low, the canvas 2 is sprayed with alcohol, water, liquid acid or a mixture thereof.

Moreover, the mesh sheet 3 is comprised of the meshes having a size of approximately 0.1 millimeters to several millimeters, and the thread of the mesh sheet 3 that may be used is of any material. If possible, the thread of a synthetic resin material may be used so that it can be re-used after washing.

Figure 1:
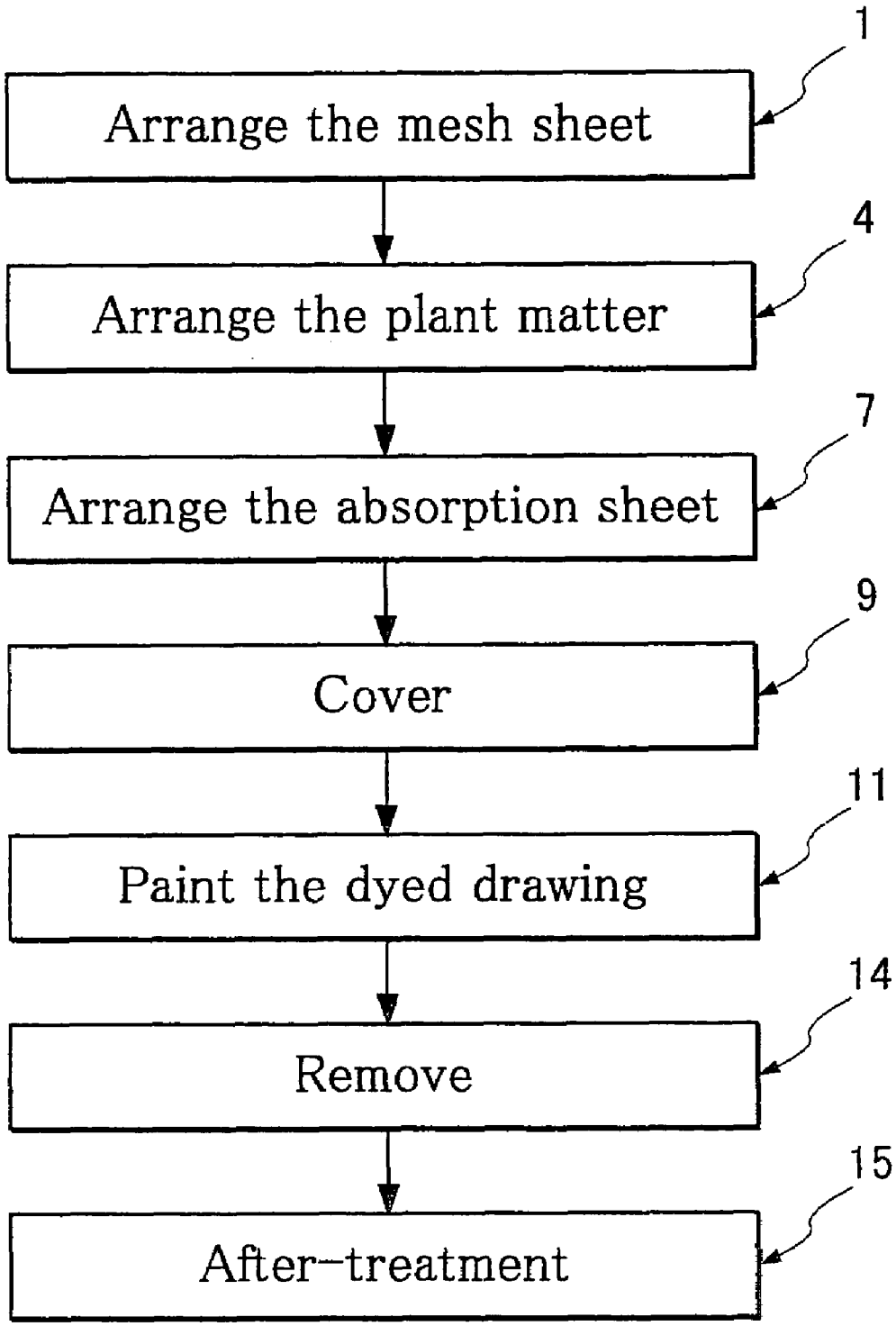
FIG. 1 is a flow diagram showing a first embodiment of the present invention.
Figure 2:
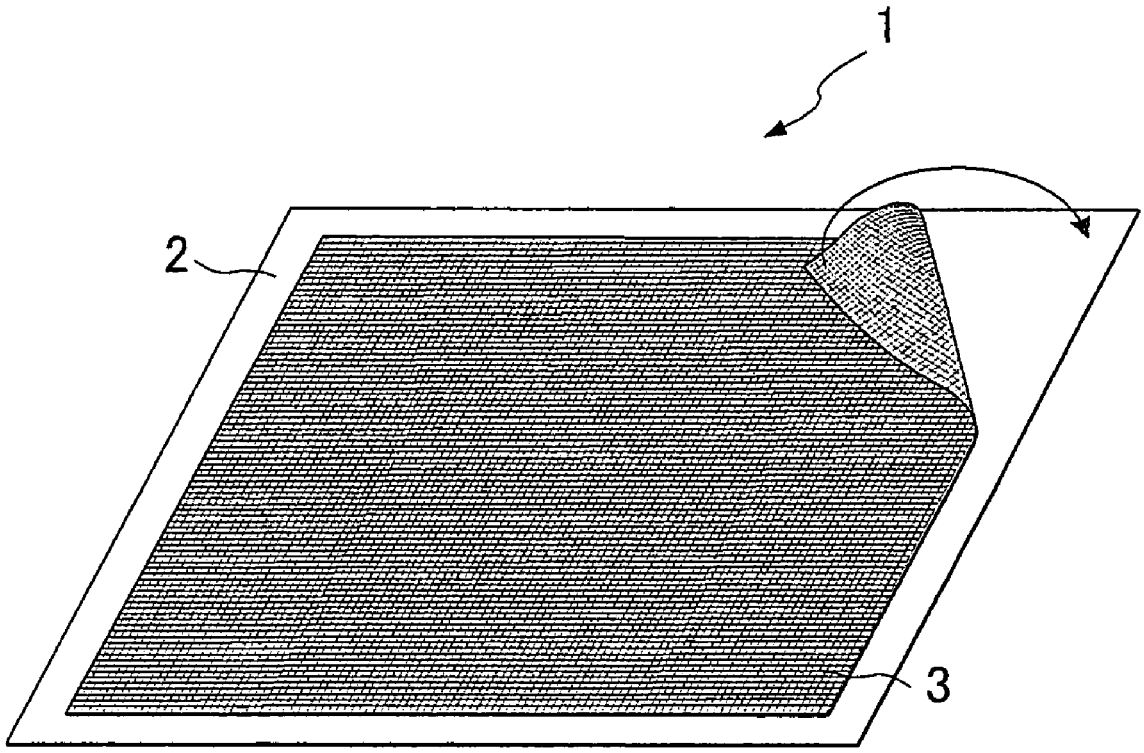
FIG. 2 is an examination view of a step for arranging a mesh sheet.
Figure 3:
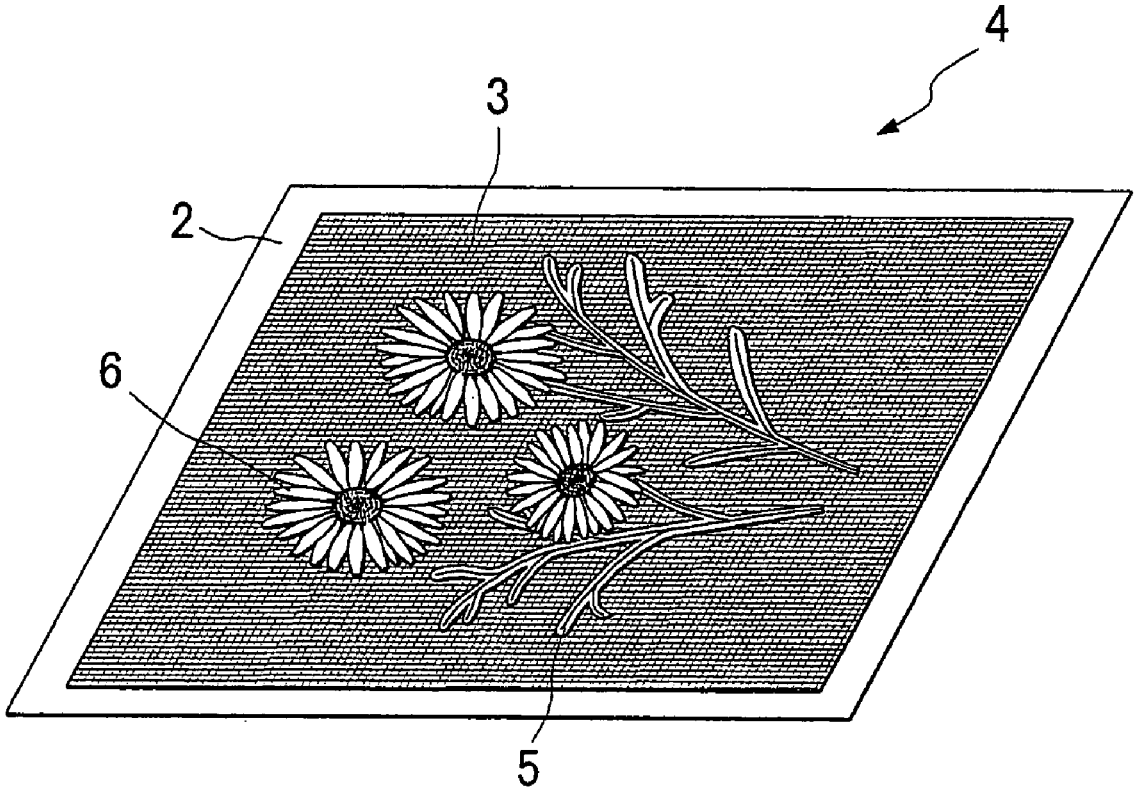
FIG. 3 is an examination view of a step for arranging plant matter.

The numeral 4 shows a step for arranging the plant matter, and as shown in FIG. 3, leaves 5 and flowers 6 of the plant matter which are used for the dyed drawing are arranged on the upper surface of the mesh sheet 3 after the mesh sheet arrangement step 1 is carried out. The leaves 5 and flowers 6 of the plant matter which are arranged on the upper surface of the mesh sheet 3 at this step 4 are used to make the pigment of the leaves 5 and flowers 6 flow out of the leaves and flowers efficiently. Thus, the back surface of the leaves 5 and flowers 6 is arranged so as to attach to the mesh sheet 3, the arrangement being such that the surface of the leaves 5 and flowers 6 is attached to the mesh sheet 3.

In addition, although the leaves 5 and flowers 6 used for the dyed drawing can be fresh flowers, the user may use pressed flowers, dried flowers restored in boiling water, hot water, water, alcohol, etc.

Figure 4:
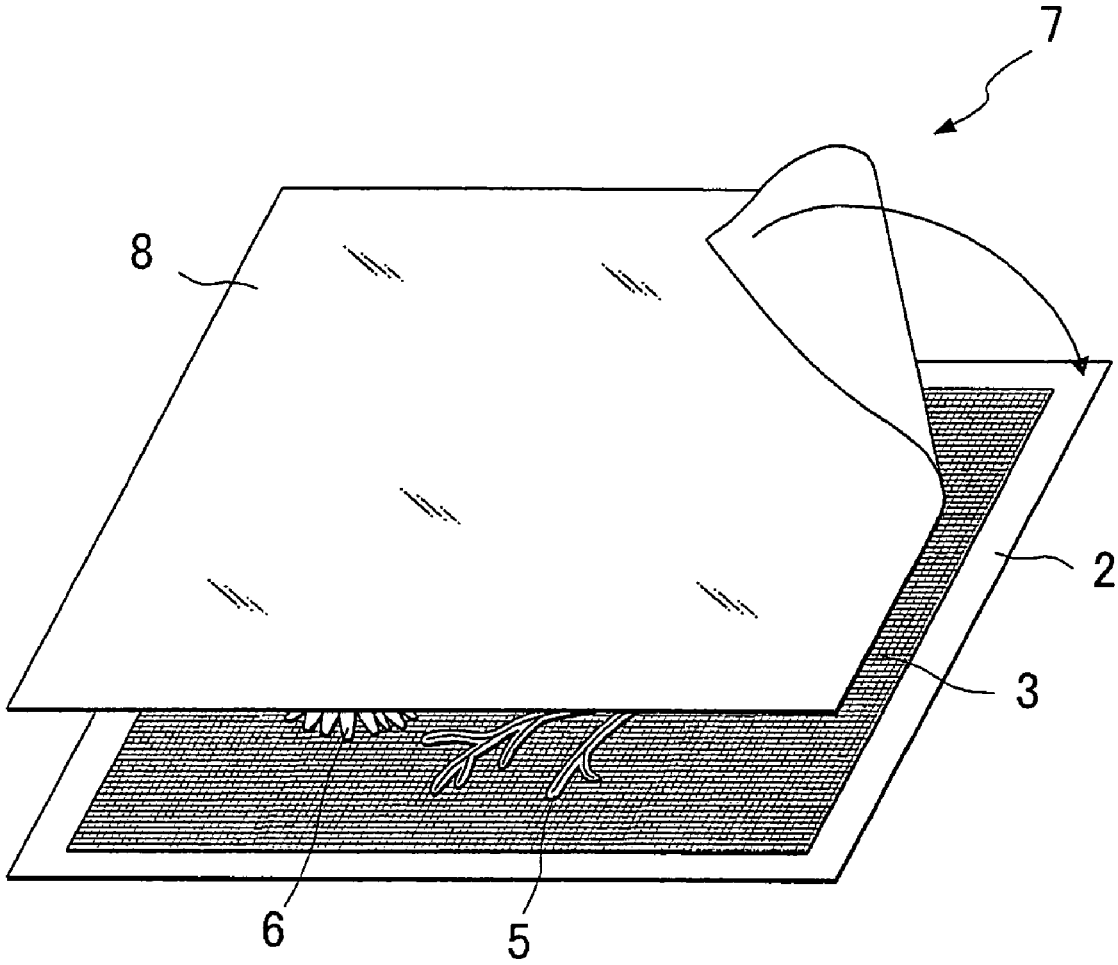
FIG. 4 is an examination view of a step for arranging an absorption sheet.

The numeral 7 shows a step for arranging a thin absorption sheet 8, and as shown in FIG. 4, the absorption sheet 8 with water absorption capabilities covers the upper surface of the plant matter after the arrangement step 4 is carried out. The water absorption sheet 8 used at this step 7 can be a tissue paper, toilet paper, etc.

Figure 5:
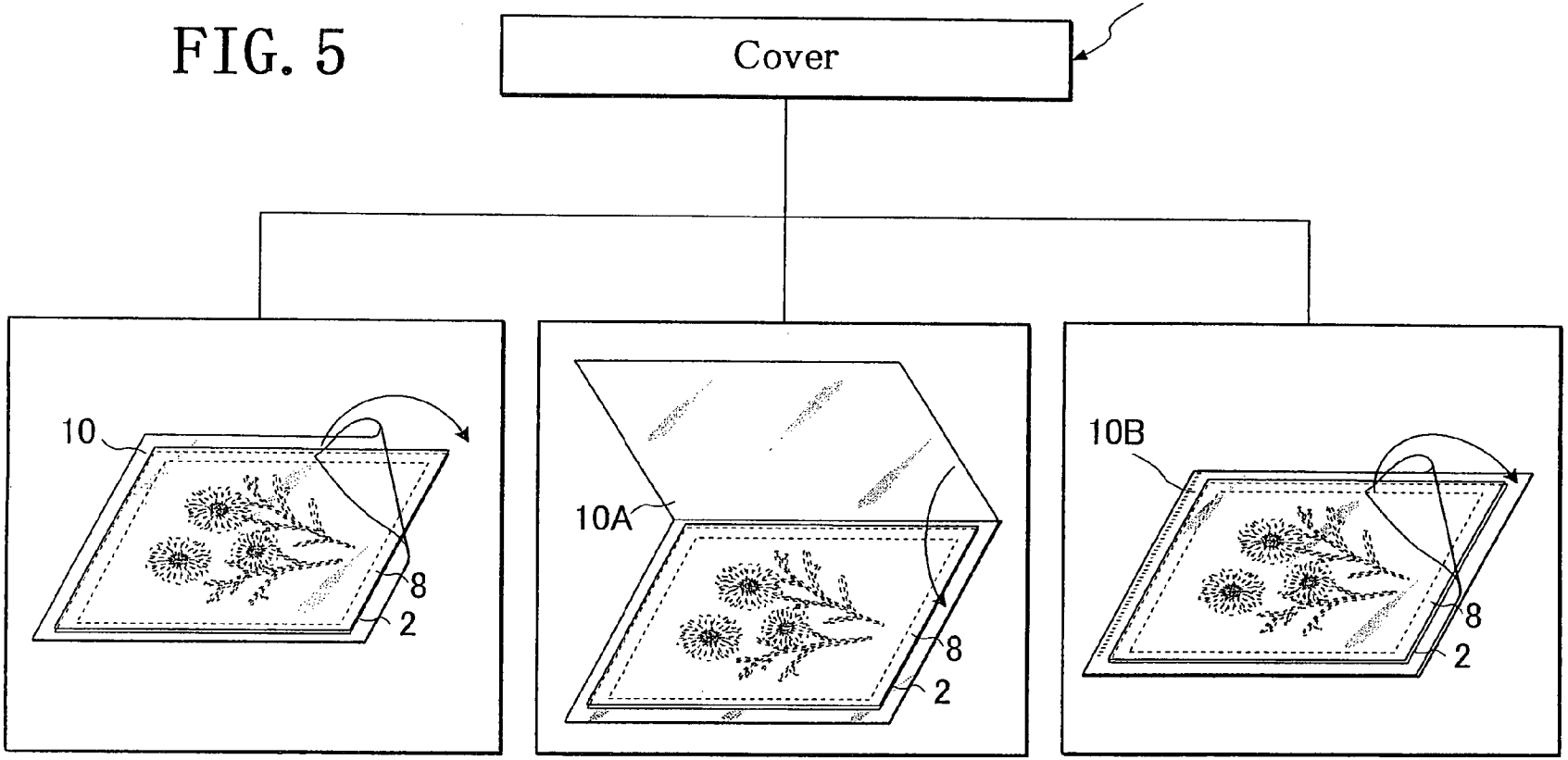
FIG. 5 is an examination view of a step for covering.

The numeral 9 shows a step for covering, and as shown in FIG. 5, a transparent or translucent synthetic resin sheet 10 covers the upper surface of the water absorption sheet 8 after the arrangement step 7 is carried out. In the covering step 9, the user may use either the synthetic resin sheet 10 formed in the shape of a sheet as covering on the upper surface of the water absorption sheet 8, the synthetic resin sheet 10A with half fold, a lower part thereof inserted under the canvas 2 for the dyed drawing and an upper part thereof covering the water absorption sheet 8, or the synthetic resin sheet 10B using the clear file.

Figure 6:
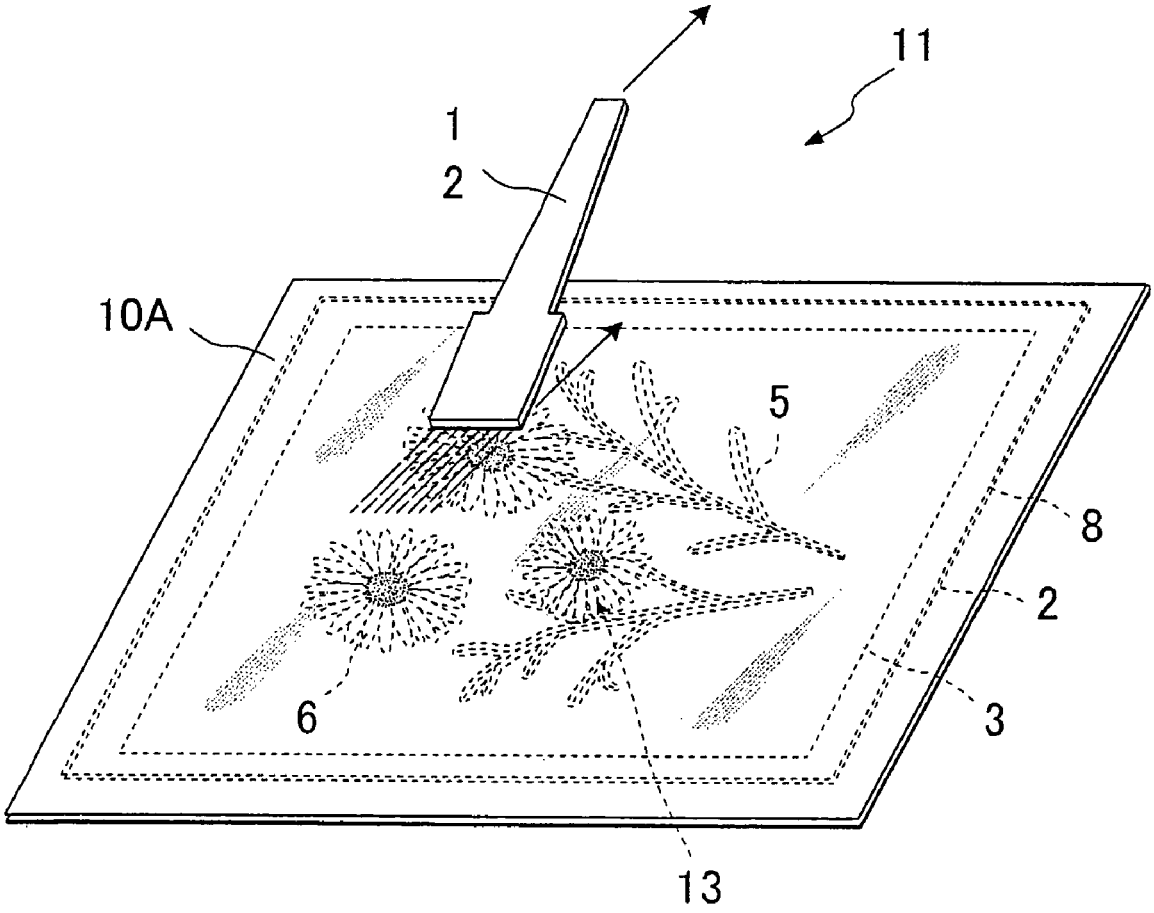
FIG. 6 is an examination view of a step for creating a dyed drawing.

The numeral 11 shows a step for creating the dyed drawing after the covering step 9 is carried out. As shown in FIG. 6, the synthetic resin sheet 10A is pressed by a spatula 12, the leaves 5 and flowers 6 of the plant matter are pushed to the mesh sheet 3, and the pigment adheres to the canvas 2 for the dyed drawing after the pigment of the plant matter flows out. Then, the water absorption sheet 8 absorbs water, and a dyed drawing 13 of the plant matter is drawn on the canvas 2 because of the pigment which flows out of the leaves 5 and flowers 6. In the creating step 11, the pigment of the leaves 5 and flowers 6 flows out after the user presses or strikes the resin sheet 10A toward the upper part of the leaves 5 and flowers 6 with the spatula 12, and the leaves 5 and flowers 6 are pushed to the mesh sheet 3 and are scratched.

In addition, the spatula 12 is formed in the shape of a rice paddle, and the shape thereof may also be formed in any design which can push so as to allow the pigment to flow out by pressing the leaves 5 and flowers 6 located under the synthetic resin sheet 10A, the design of the spatula including a roller attached at a tip portion of the spatula, marble, spatula with spherical surface including hemisphere and the like.

Figure 7:
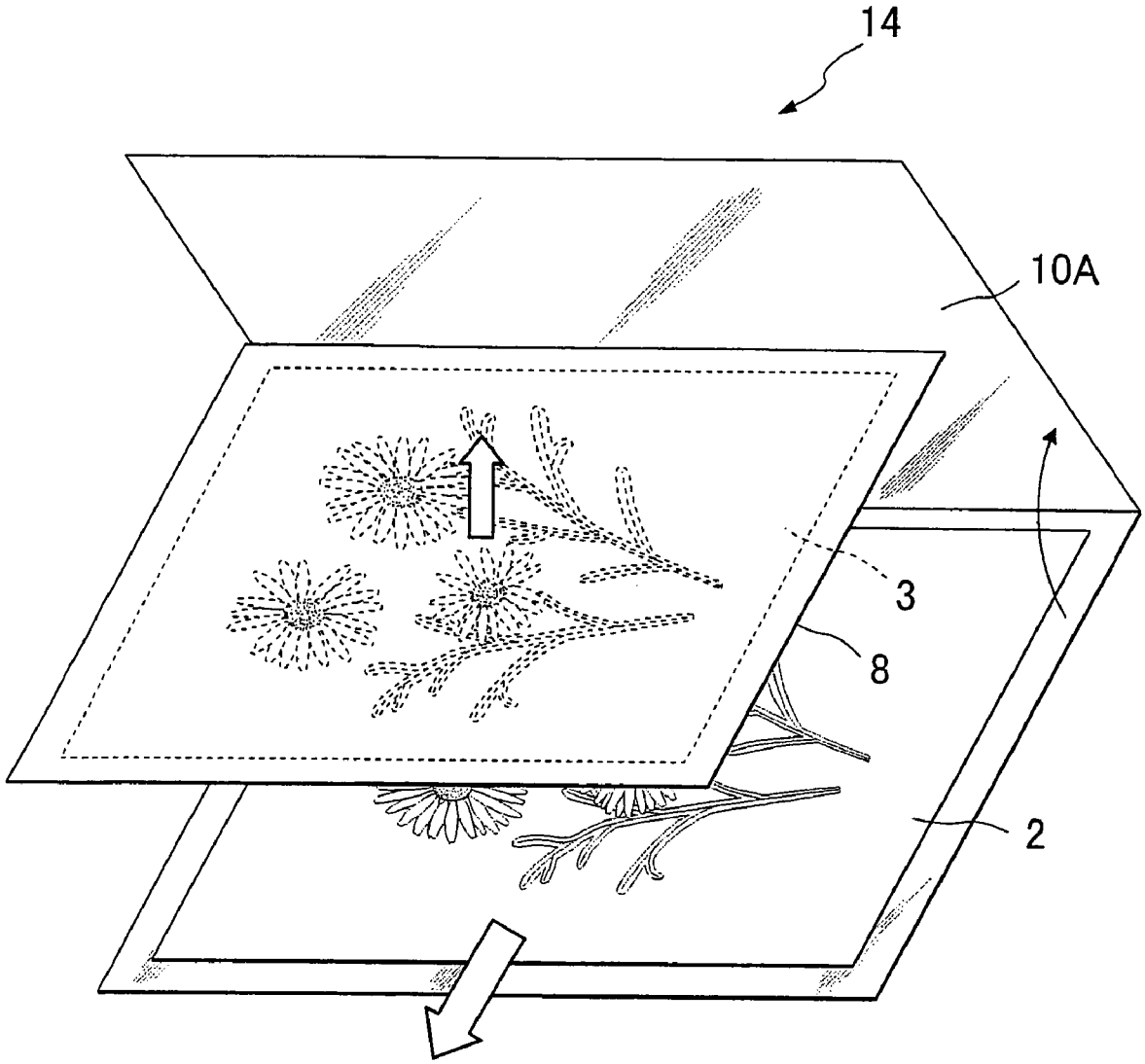
FIG. 7 is an examination view of a step for removing.

As shown in FIG. 7, the numeral 14 shows a step for removing the mesh sheet 3, the leaves 5 and flowers 6 of the plant matter, the water absorption sheet 8 and the synthetic resin sheet 10A which is located on the surface of the canvas 2 after the creating step 11 is carried out.

Figure 8:
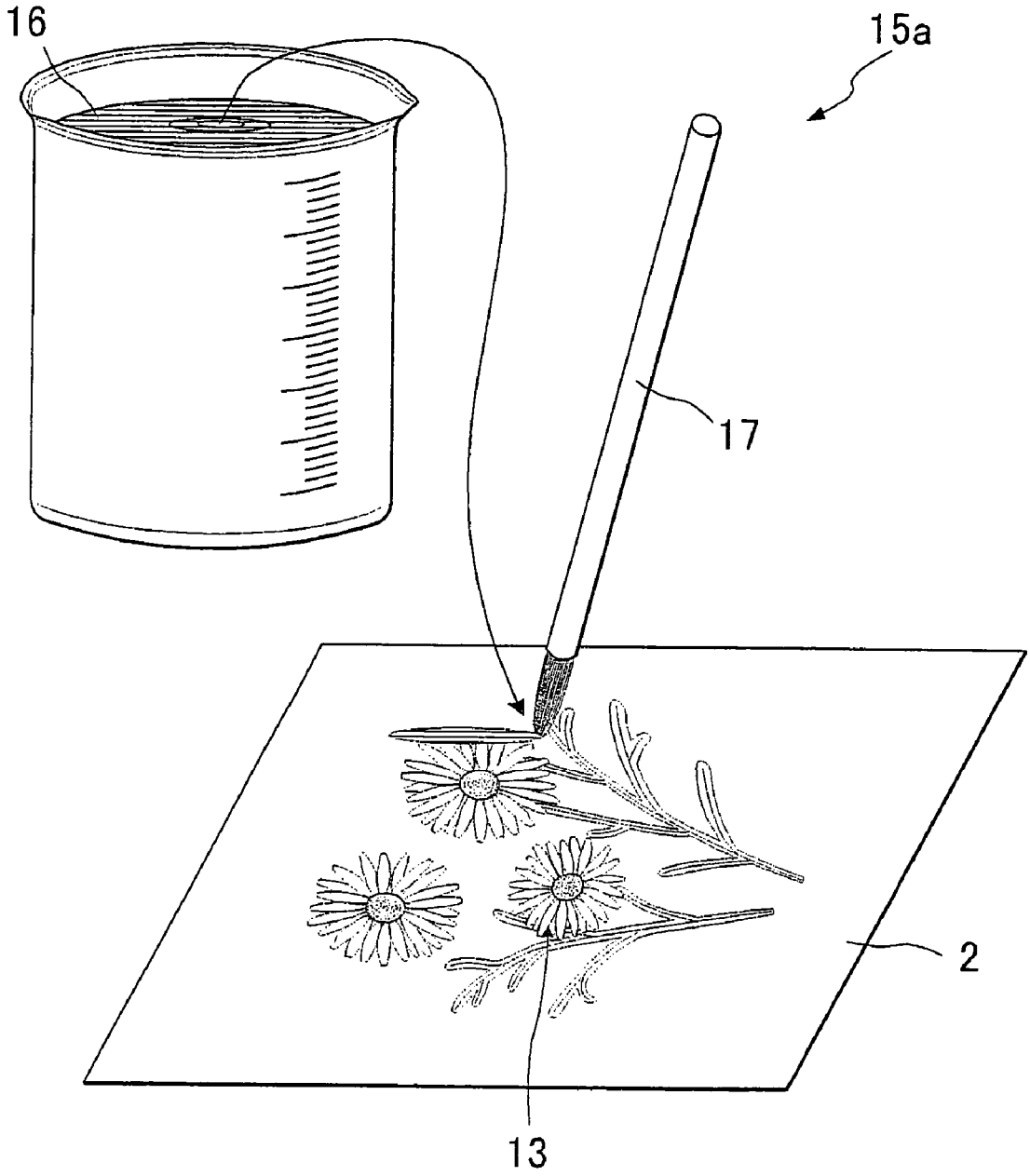
FIG. 8 is an examination view of a step for fixing a pigment.

The numeral 15 shows a step for after-treatment if needed after the removal step 14 is carried out. As shown in FIG. 8, in the embodiment of the present invention, the after-treatment step 15 is a step 15a for fixing the pigment of part of the dyed drawing 13. In the fixing step 15a, a pigment fixing solution 16 including alum liquid and salt water is applied on part of the dyed drawing 13 by a brush 17. Moreover, if necessary, the user may coat with resin including silicon and acrylics, or hot-melt resin on the upper surface of the dyed drawing 13.

The dyed drawing 13 of the plant drawn on the canvas 2 by the creation method of the dyed drawing creates the picture such that the pigment of the outline of the leaves 5 and flowers 6 are transferred.

Moreover, when the leaves 5 and flowers 6 are pushed and pressed to the mesh sheet 3 by the spatula 12, the parts of the leaves 5 and flowers 6 attached to the mesh sheet 3 are scratched, and the pigment flows out efficiently and adheres to the canvas 2 to form the dyed drawing.

Figure 9:
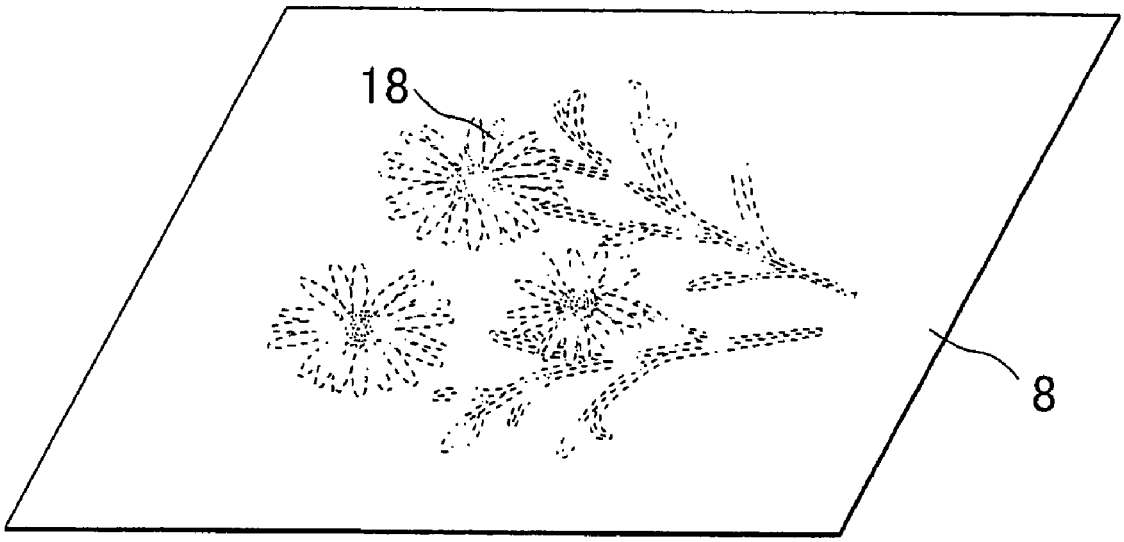
FIG. 9 is an examination view showing the way in which the extra pigment is absorbed in the absorption sheet.

Furthermore, the spatula 12 slides with pressing on the synthetic resin sheet 10A so that the leaves 5 and flowers 6 are fixed and their outlines are not broken; the pigment can be adhered to the canvas 2 for the dyed drawing such that the outlines of the leaves 5 and flowers 6 still exist; and the extra pigment 18 is absorbed by the water absorption sheet 8 as shown in FIG. 9. Because the pigment adheres to the water absorption sheet, the user can check the outline of the leaves 5 and flowers 6 and can operate the spatula 12 with proper adjustments.

Other embodiments of the present invention will now be described with reference to FIGS. 10–50. In FIGS. 10–50, the same components as in the first embodiment described above with reference to FIGS. 10–50 are designated by the same reference numerals and therefore will not be further explained in great detail.

Figure 10:
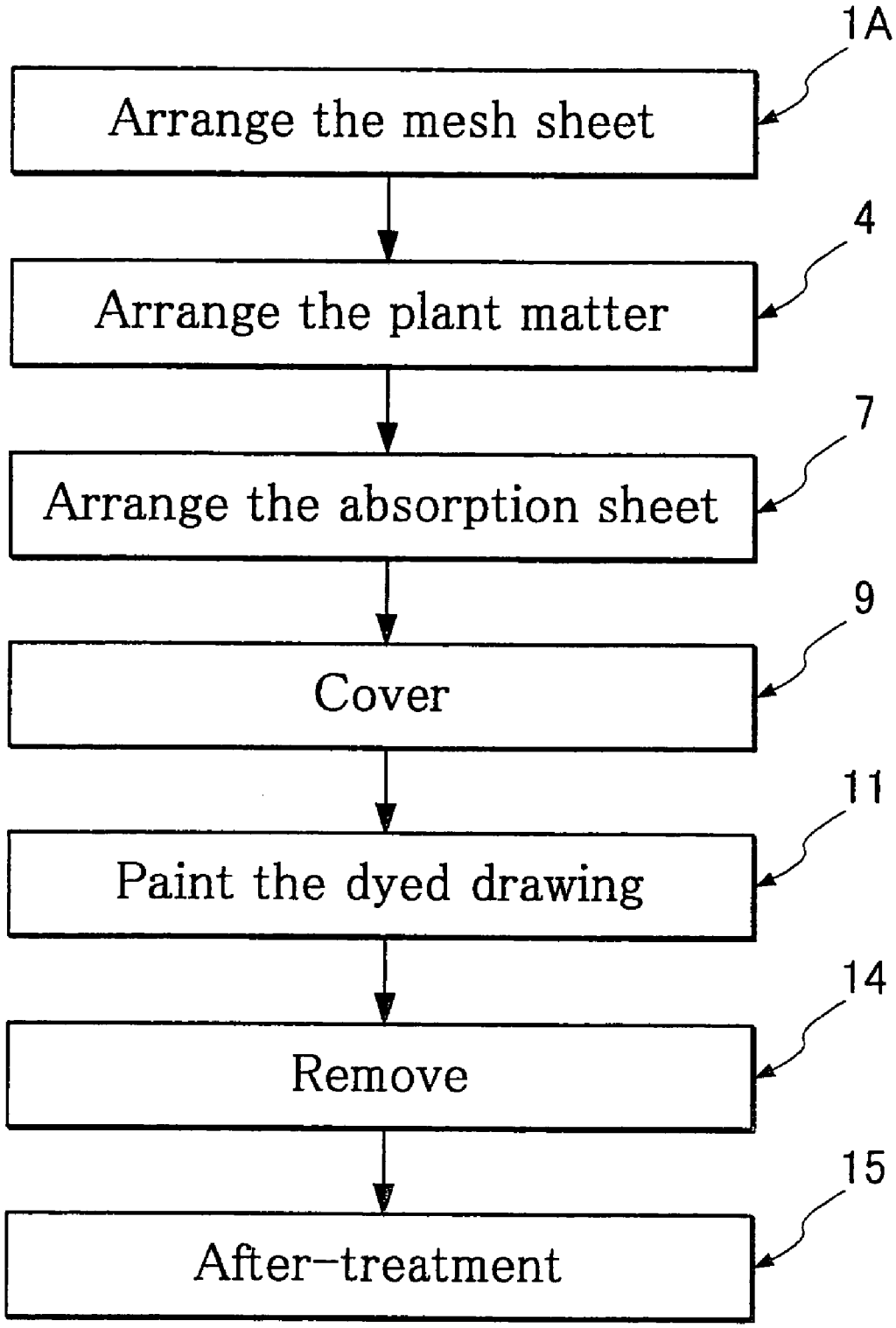
FIG. 10 is a flow diagram showing a second embodiment of the present invention.
Figure 11:
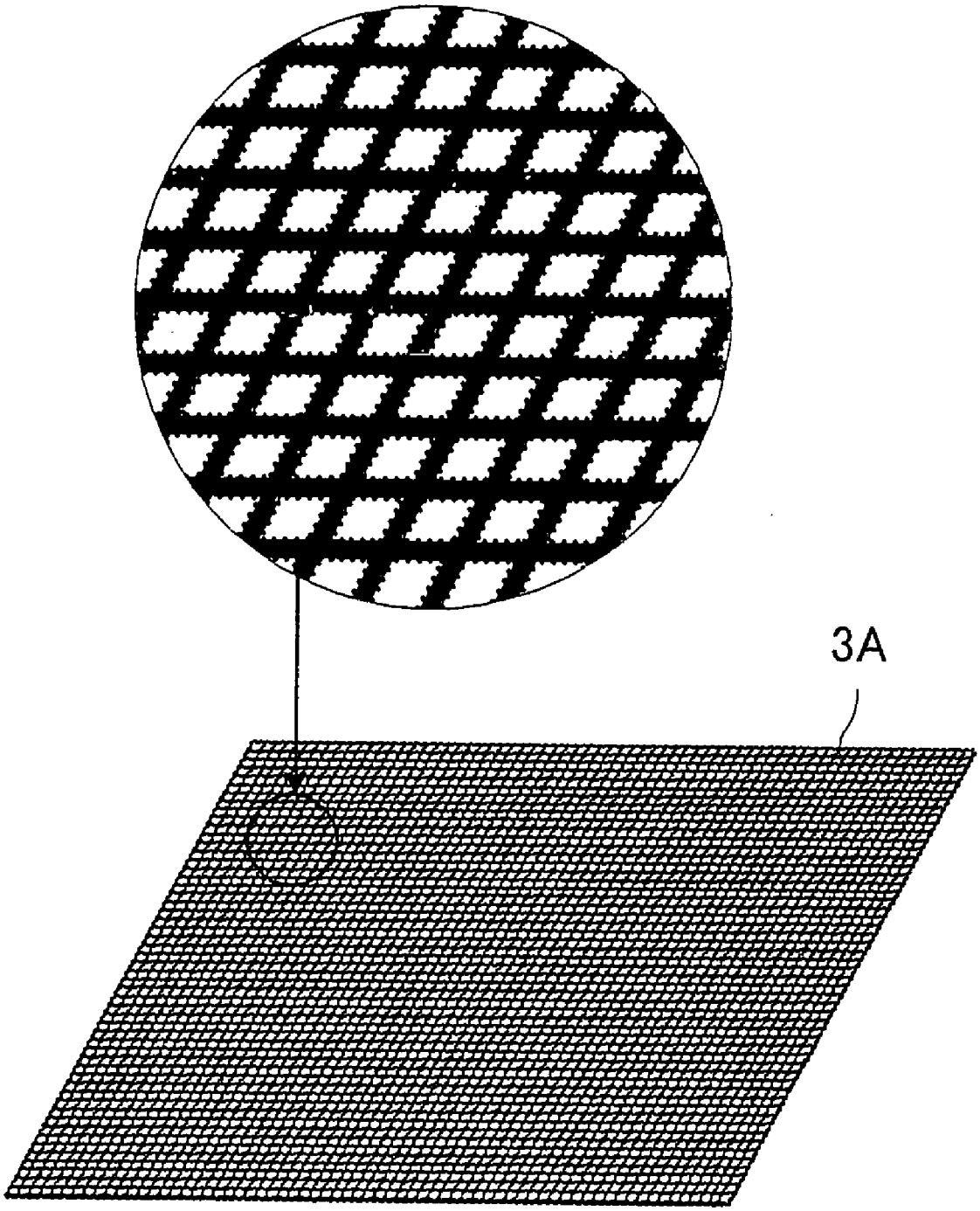
FIG. 11 is an examination view of a mesh sheet.
Figure 12:
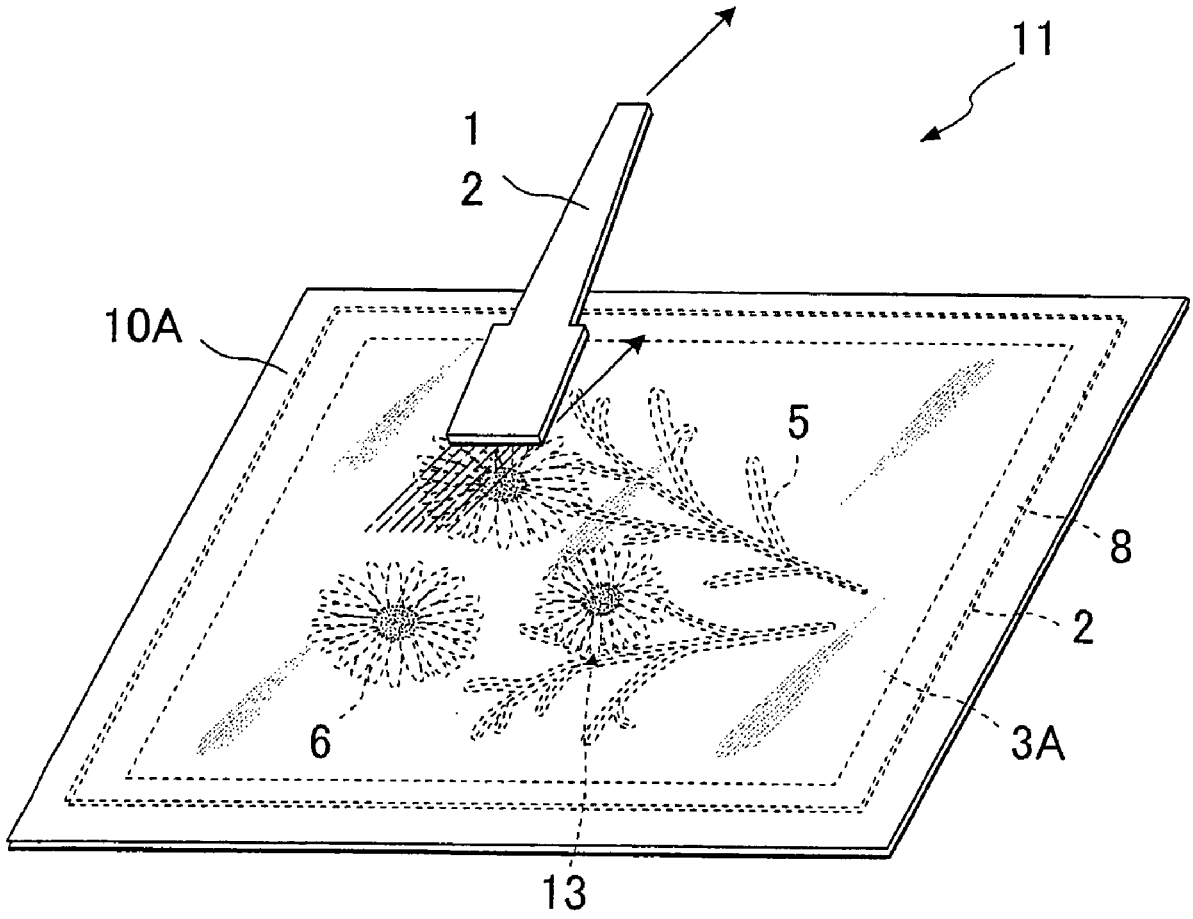
FIG. 12 is an examination view of a step for creating a dyed drawing.

A second embodiment of the present invention is shown in FIGS. 10–12. It is distinguished from the first embodiment in that the arrangement step is replaced with step 1A. In this step 1A, a mesh sheet 3A formed of sand paper formed in the shape of a mesh is used. A creation method of a dyed drawing of a plant matter with the arrangement step 1A can cause the flowing out of the pigment by scratching efficiently the leaves 5 and flowers 6 of the plant matter.

Figure 13:
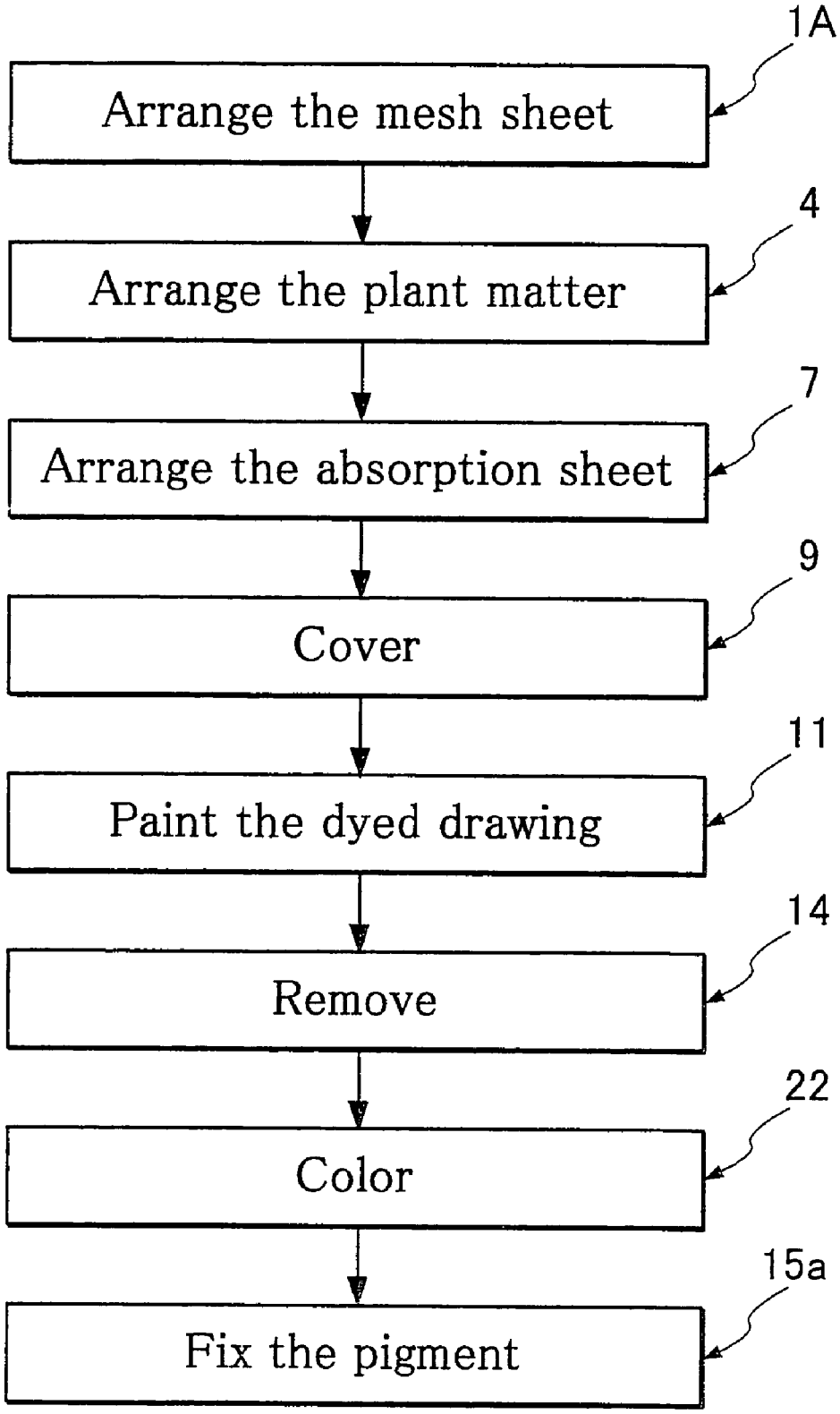
FIG. 13 is a flow diagram showing a third embodiment of the present invention.
Figure 14:
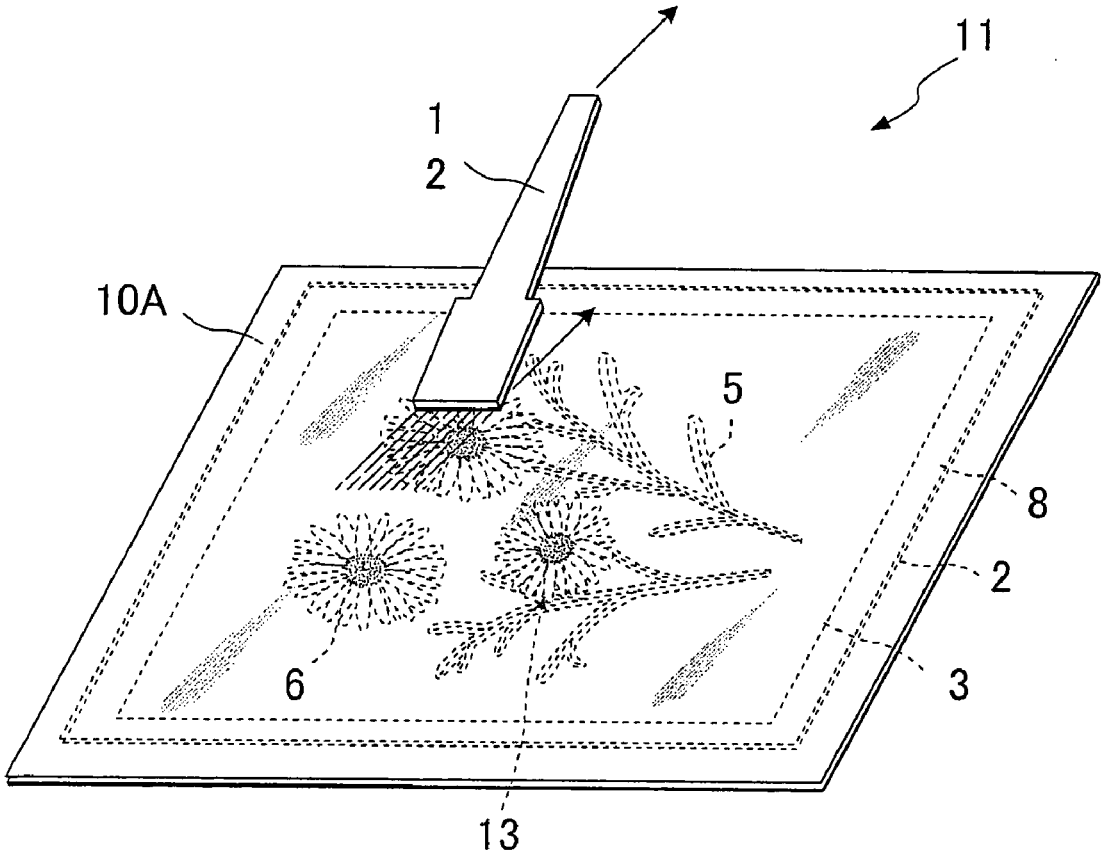
FIG. 14 is an examination view of a step for creating a dyed drawing.
Figure 15:
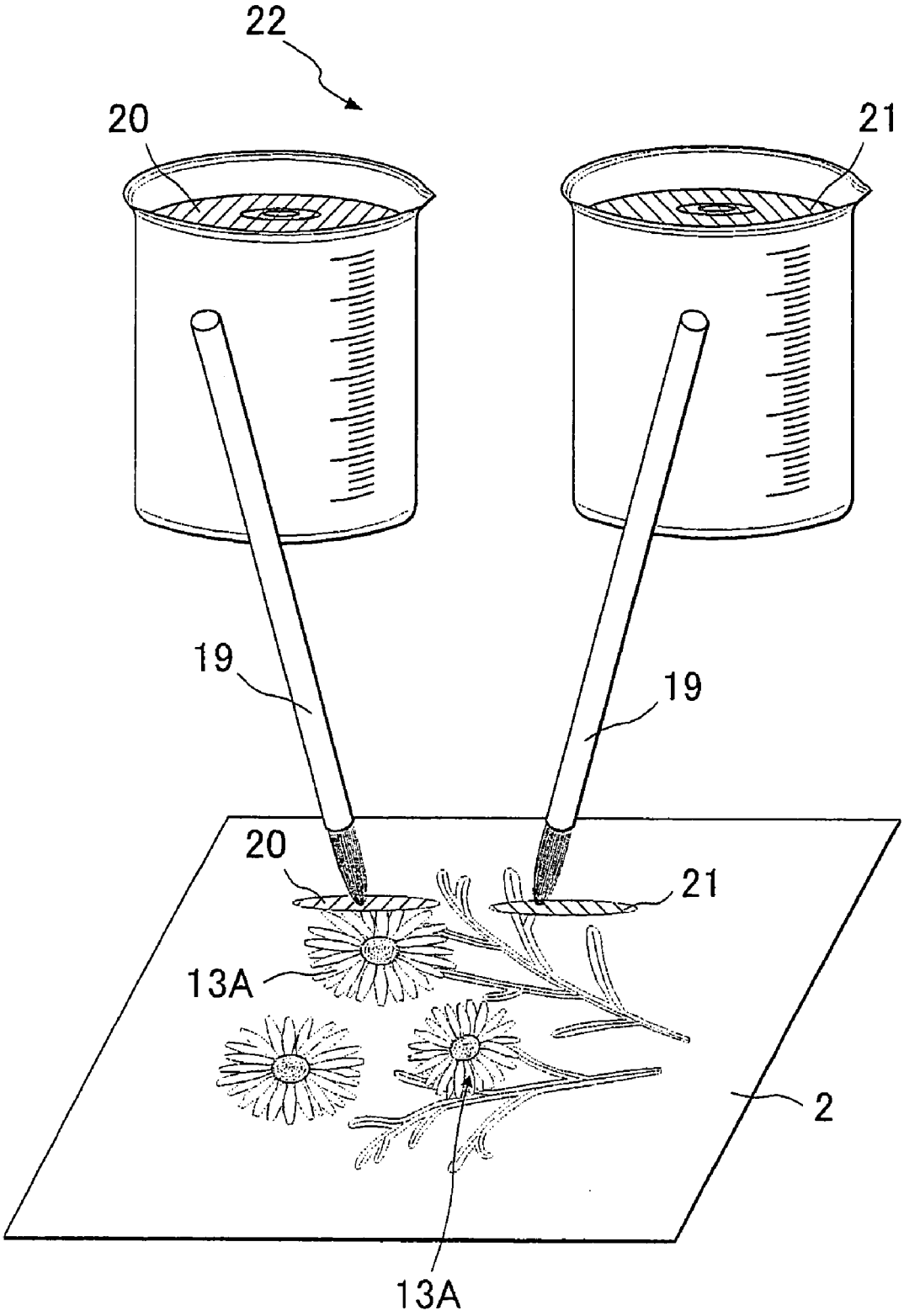
FIG. 15 is an examination view of a step for coloring.

A third embodiment of the present invention is shown in FIGS. 13–15. It is distinguished from the first embodiment in that the after-treatment step 15 is replaced with after-treatment step 15A which further includes a step 22 for coloring. In the coloring step 22, an acid solution 20 including lactic acid, citric acid for red or purple leaves 5 and flowers 6 and an alkali solution 21 including baking soda, sodium hydrate for yellow or green leaves 5 and flowers 6 are applied on the dyed drawing 13 of the plant drawn on the canvas 2 by a brush 19 before the fixing step 15a is carried out. A creation method of a dyed drawing of a plant matter with the after-treatment step 15A including the color step 22 according to the second embodiment has similar advantages to that according to the first embodiment and a colorful dyed drawing 13A is created.

Figure 16:
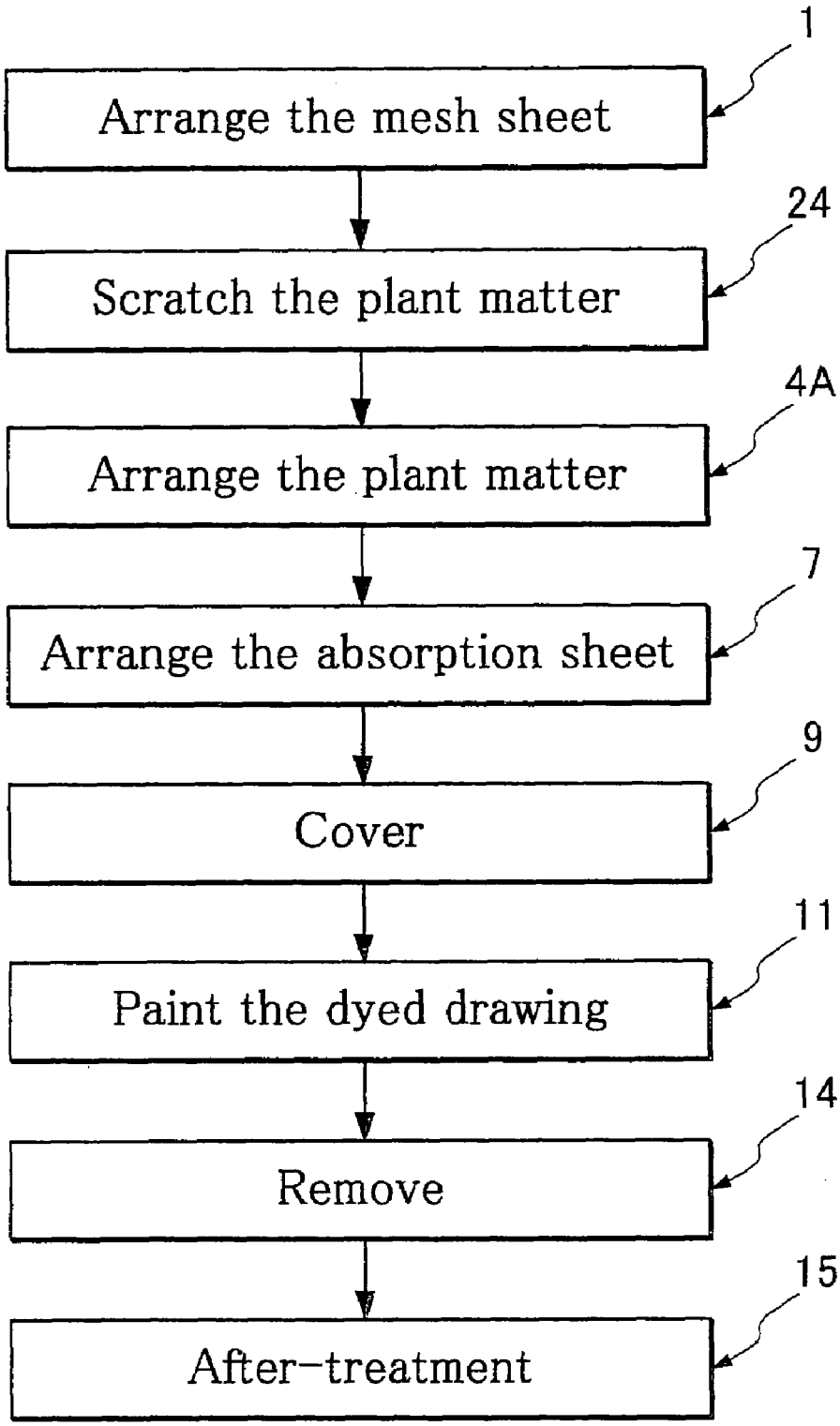
FIG. 16 is a flow diagram showing a fourth embodiment of the present invention.
Figure 17:
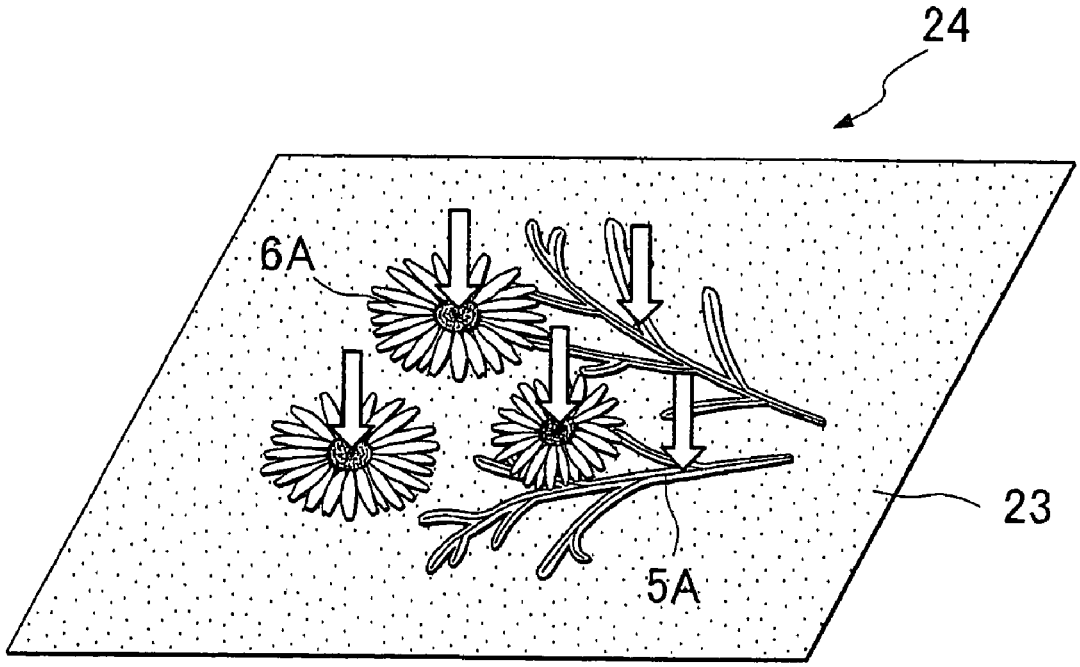
FIG. 17 is an examination view of a step for scratching plant matter.
Figure 18:
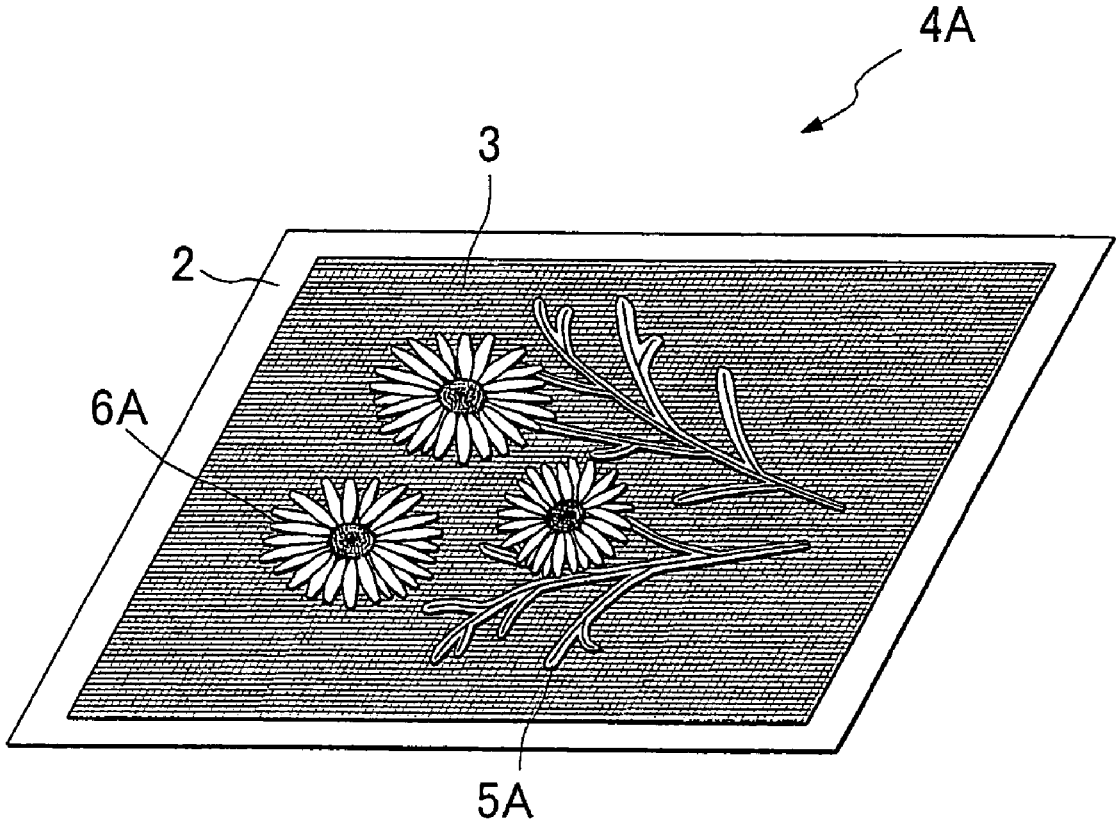
FIG. 18 is an examination view of a step for arranging plant matter.
Figure 19:
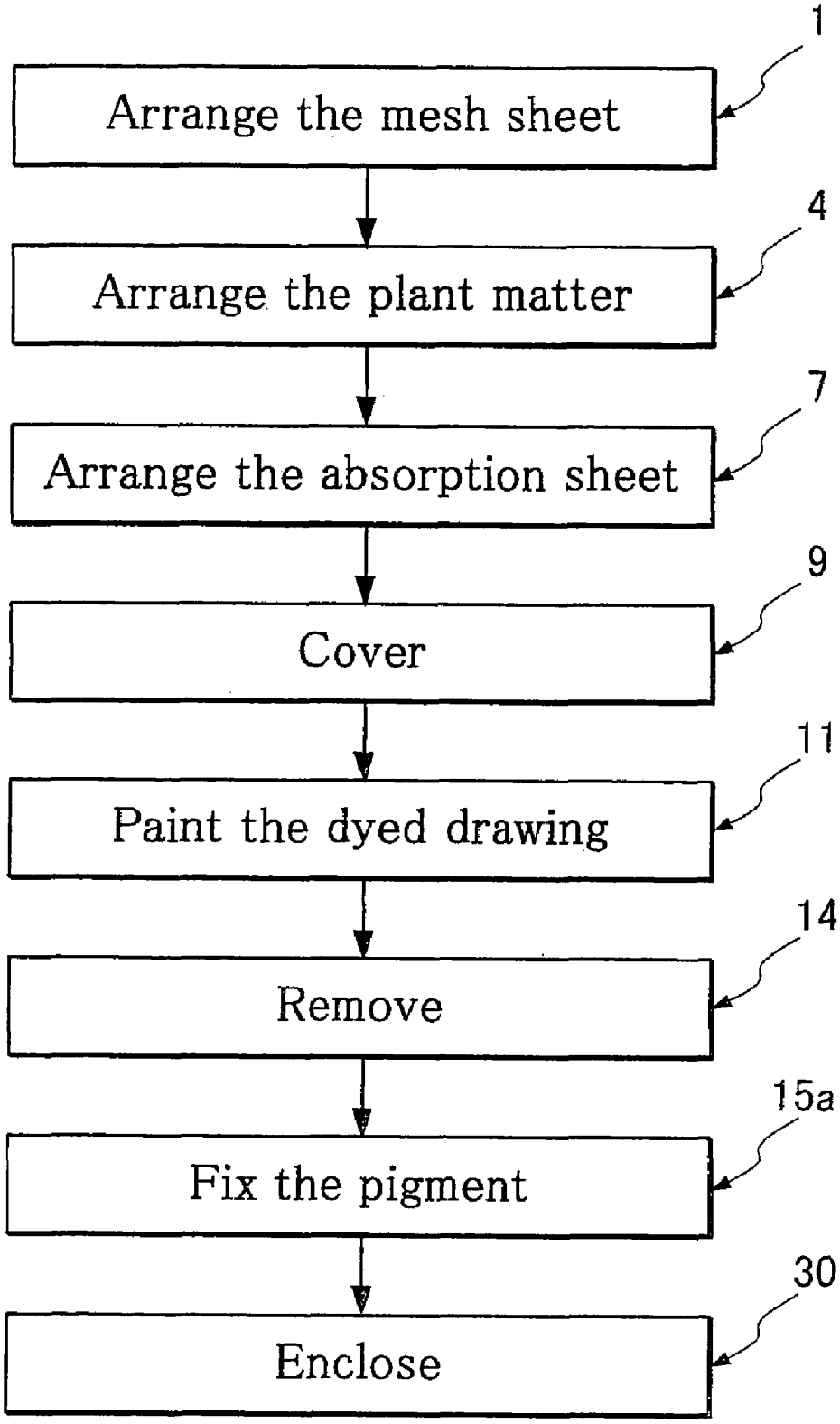
FIG. 19 is a flow diagram showing a fifth embodiment of the present invention.
Figure 20:
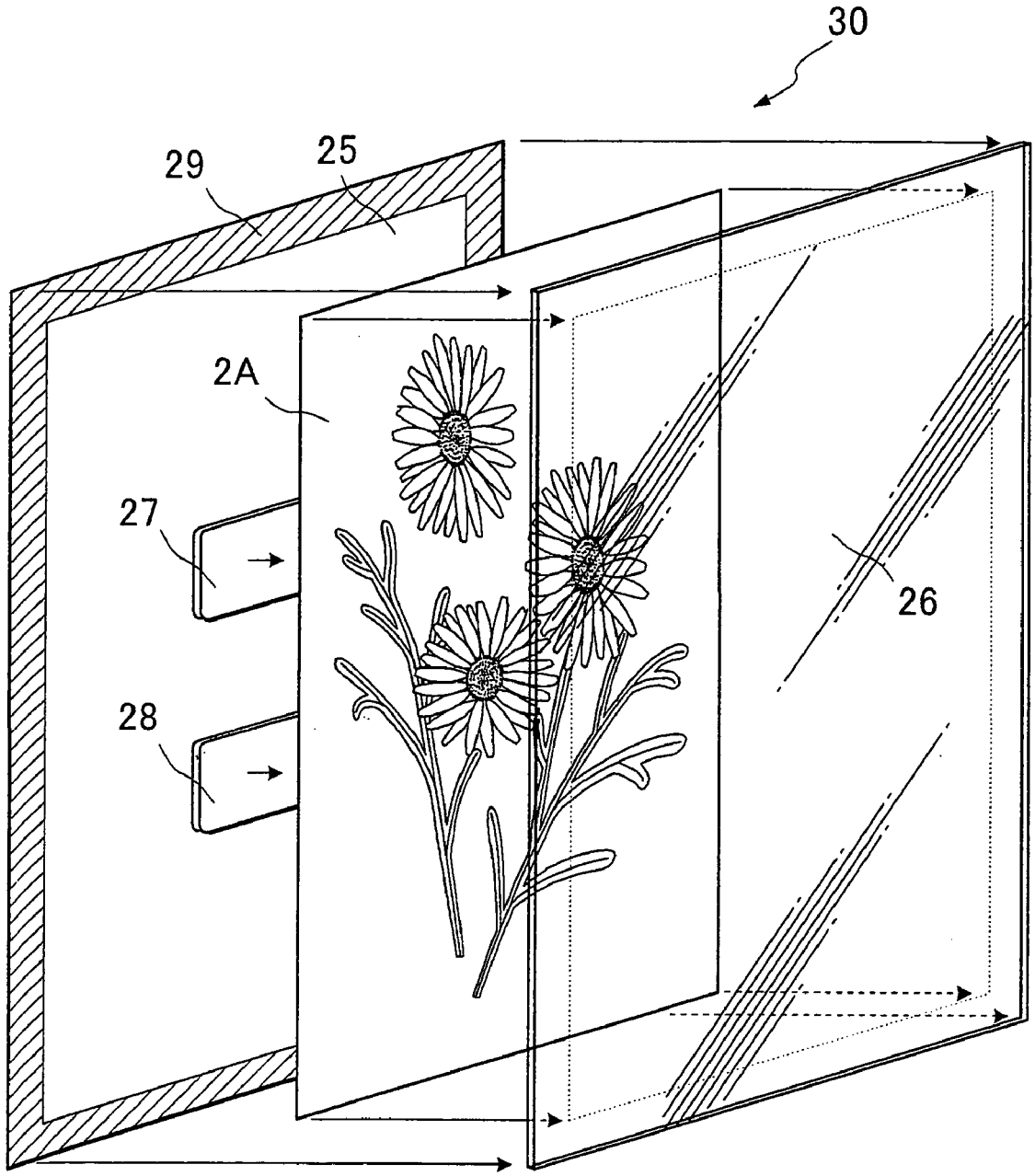
FIG. 20 is an examination view of a step for enclosing.
Figure 21:
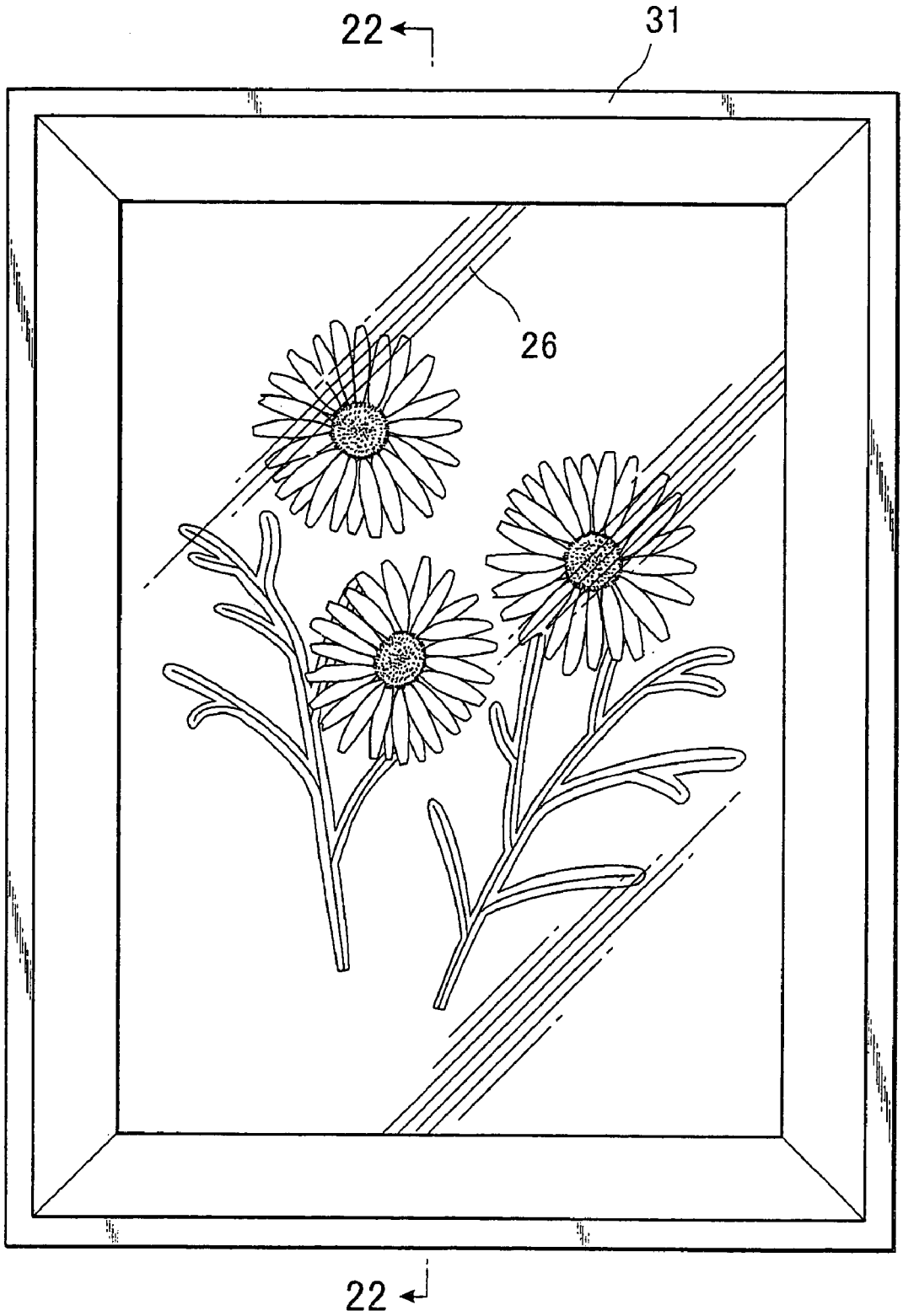
FIG. 21 is a front view showing the way in which it is put in a picture frame.
Figure 22:
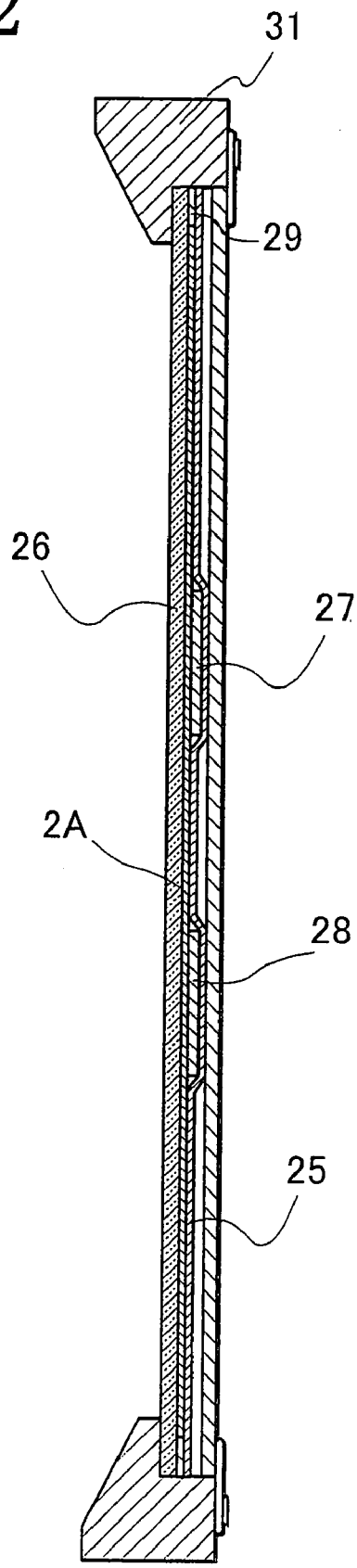
FIG. 22 is a cross sectional view taken along a line 22—22 of FIG. 21.

A fourth embodiment of the present invention is shown in FIGS. 16–18. It is distinguished from the first embodiment in that the a step 24 for scratching the surface or back of the leaves 5 and flowers 6 with sand paper so as to cause the outflow of pigment easily after the arrangement step 1 is carried out, after that, there is a step for arranging the leaves 5 and flowers 6 which are scratched on the mesh sheet 3. A creation method of the dyed drawing of a plant matter with the scratching step 24 according to the fourth embodiment has similar advantages to that according to the first embodiment, and the pigment of the leaves 5 and flowers 6 with a low water content can be transferred efficiently to the canvas 2 for the dyed drawing.

A fifth embodiment of the present invention is shown in FIGS. 19–22. It is distinguished from the first embodiment in that the after-treatment step 15 is replaced with another step 15B which includes a step 30 for enclosing. The enclosing step 30 is carried out after the fixing step 15a is carried out, a canvas 2A for the dyed drawing is interposed between an aluminum foil 25, including the foil adhered to a flexible resin sheet at the outer surface thereof, and a glass plate 26 through a desiccant 27, a deoxidizer 28 and the like, and the aluminum foil 25 and glass plate 26 are fixed at the outer circumferential part thereof with adhesive 29 at a sealing state. After that, the canvas 2A is enclosed in a frame 31 and displayed. A creation method for a dyed drawing of plant matter with the after-treatment step 15B including the enclosing step according to the fifth embodiment may be carried out.

Figure 23:
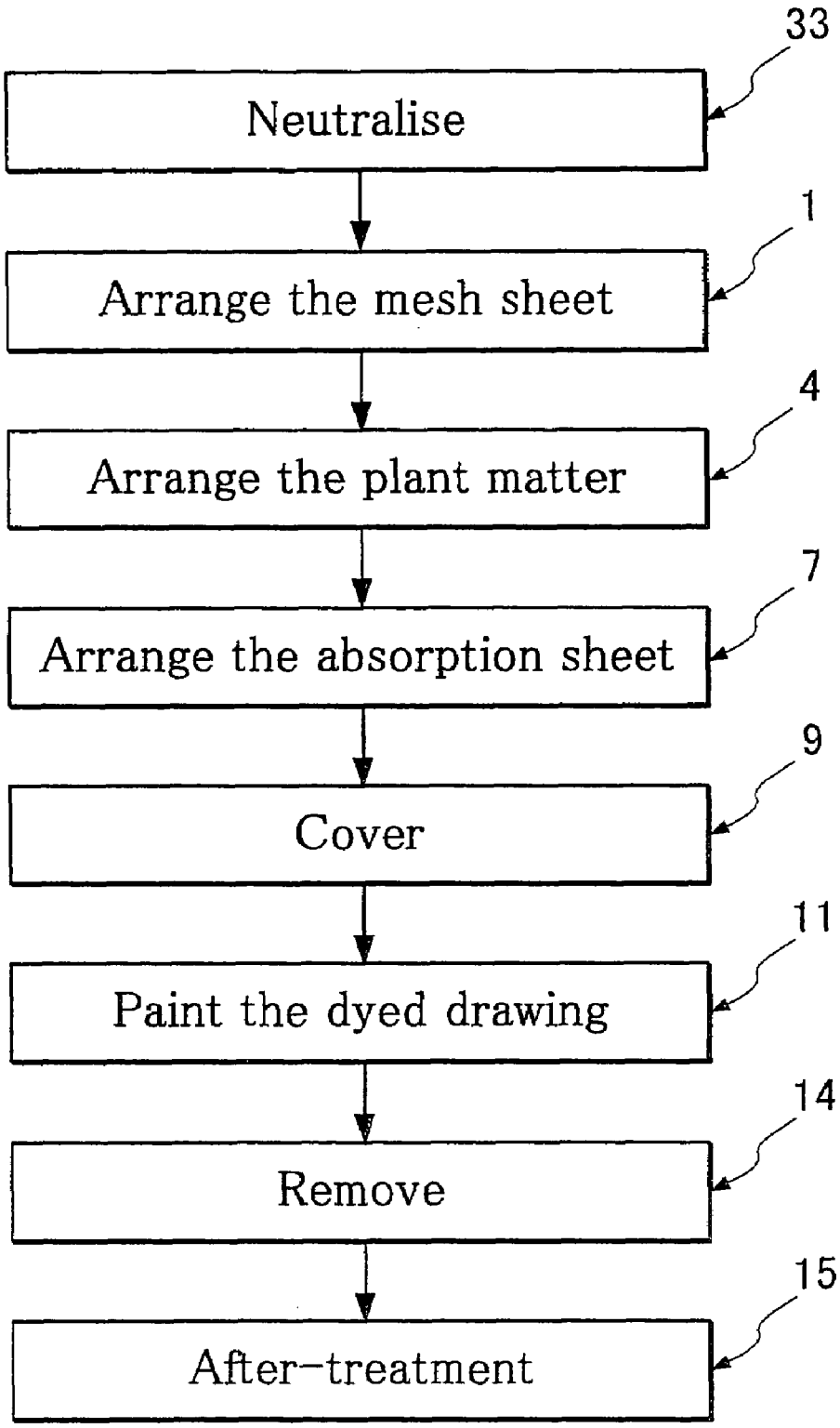
FIG. 23 is a flow diagram showing a sixth embodiment of the present invention.
Figure 24:
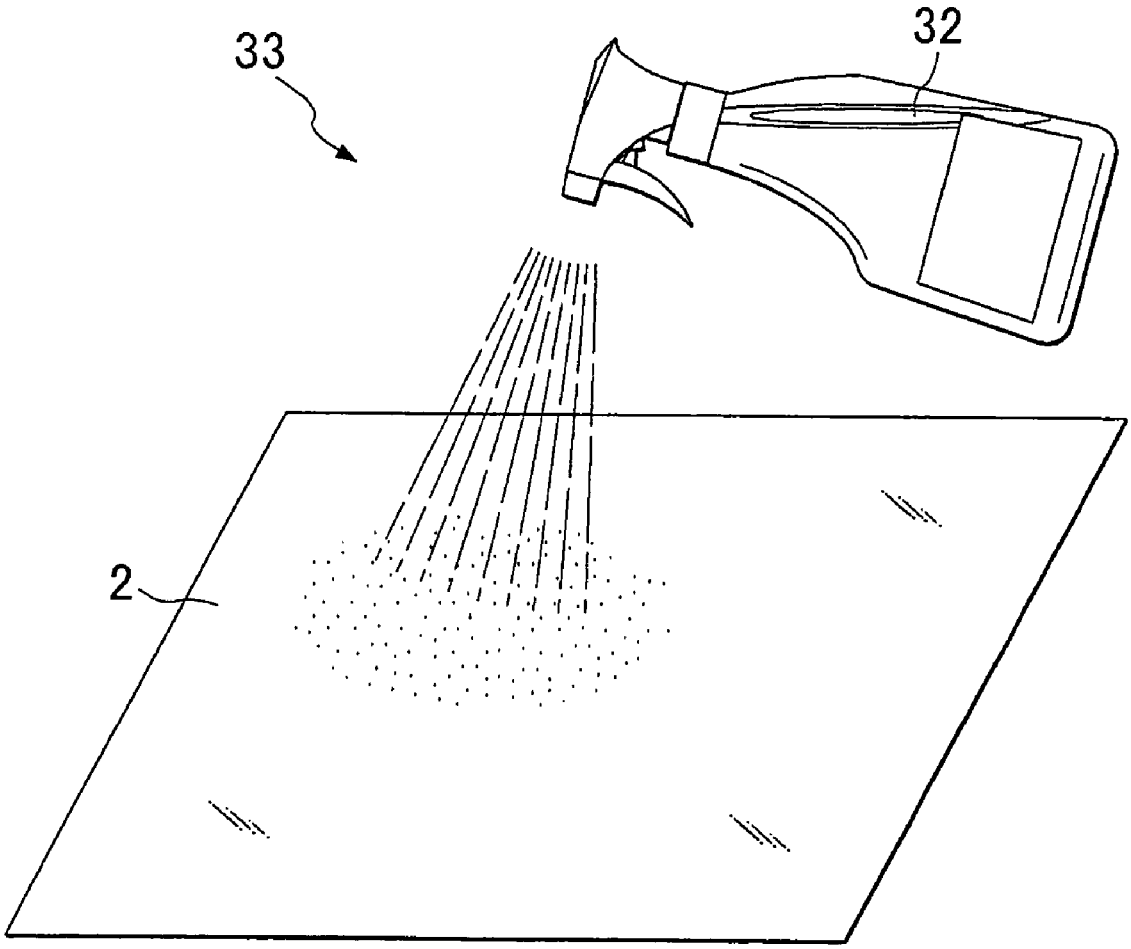
FIG. 24 is an examination view of a step for neutralizing an object for dyed drawing.

A sixth embodiment of the present invention is shown in FIGS. 23 and 24. It is distinguished from the first embodiment in that a step 33 for neutralizing the canvas 2 before the arrangement step 1 is carried out. In the neutralizing step 33, alkali solution is applied or sprayed when the acid canvas 2 for the dyed drawing is used, and the acid solution is applied or sprayed when the alkaline canvas 2 for the dyed drawing is used. A creation method of a dyed drawing of plant matter with the neutralizing step 33 according to the sixth embodiment may be carried out.

Figure 25:
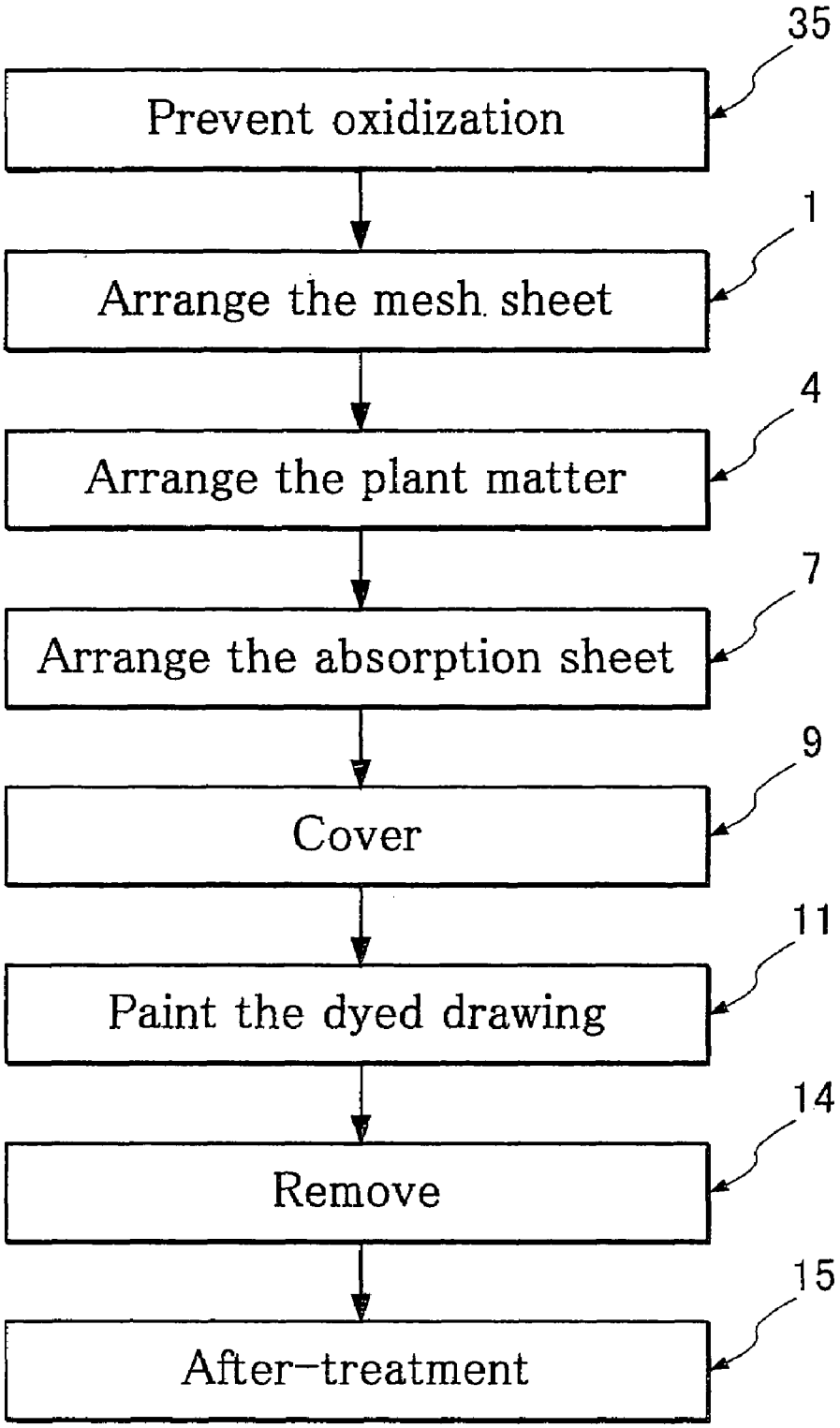
FIG. 25 is a flow diagram showing a seventh embodiment of the present invention.
Figure 26:
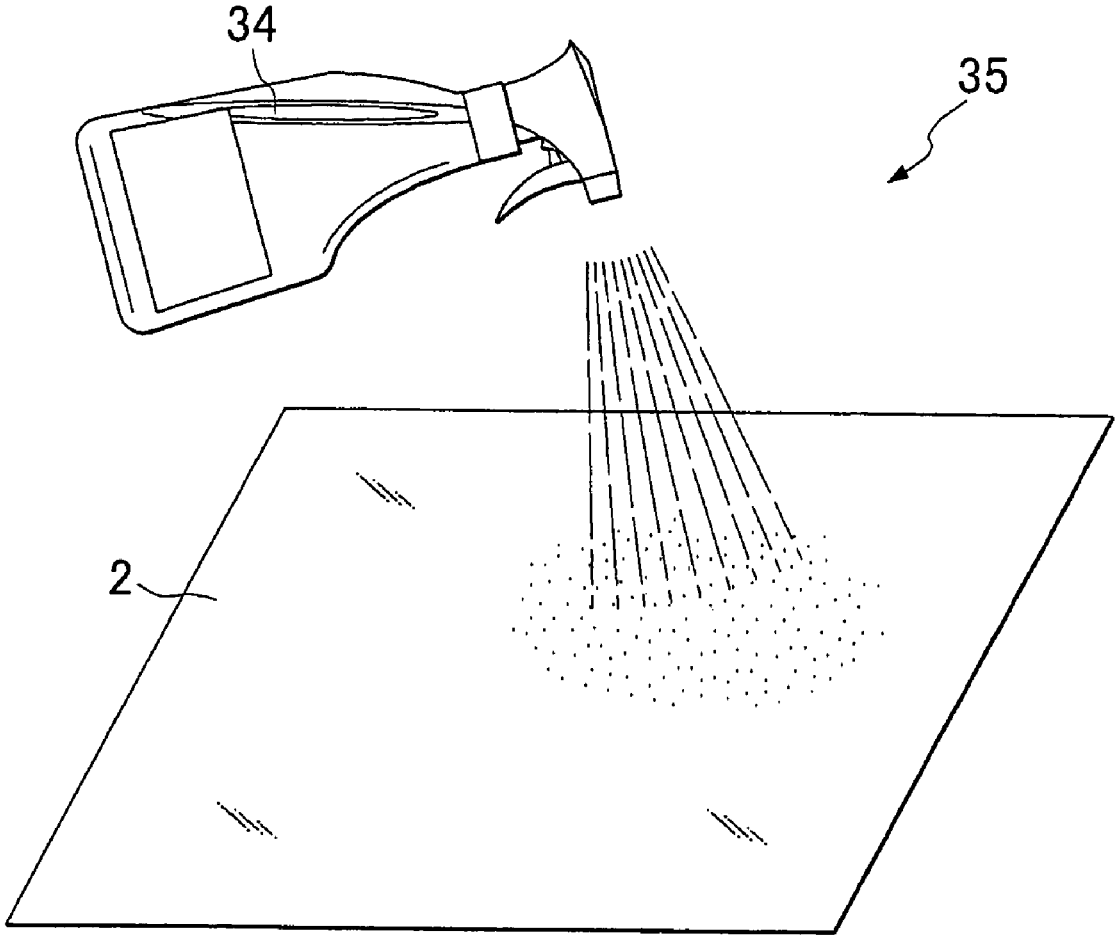
FIG. 26 is an examination view of a step for preventing oxidization.

A seventh embodiment of the present invention is shown in FIGS. 25 and 26. It is distinguished from the sixth embodiment in that a step 35 for preventing oxidation of the dyed drawing before the arrangement step 1 is carried out. In the preventing step 35, an anti-oxidization agent 34 is applied or sprayed on the canvas 2 for the dyed drawing. A creation method of a dyed drawing of a plant matter with the preventing step 35 according to the sixth embodiment may be carried out. In addition, in the embodiments of the present invention, the fixing step 15 and coloring step 22 are used as the after-treatment step. Then, only the coloring step 22 may be carried out without the fixing step 15, the after-treatment step without the fixing step 15 and coloring step 22 may be carried out.

Figure 27:
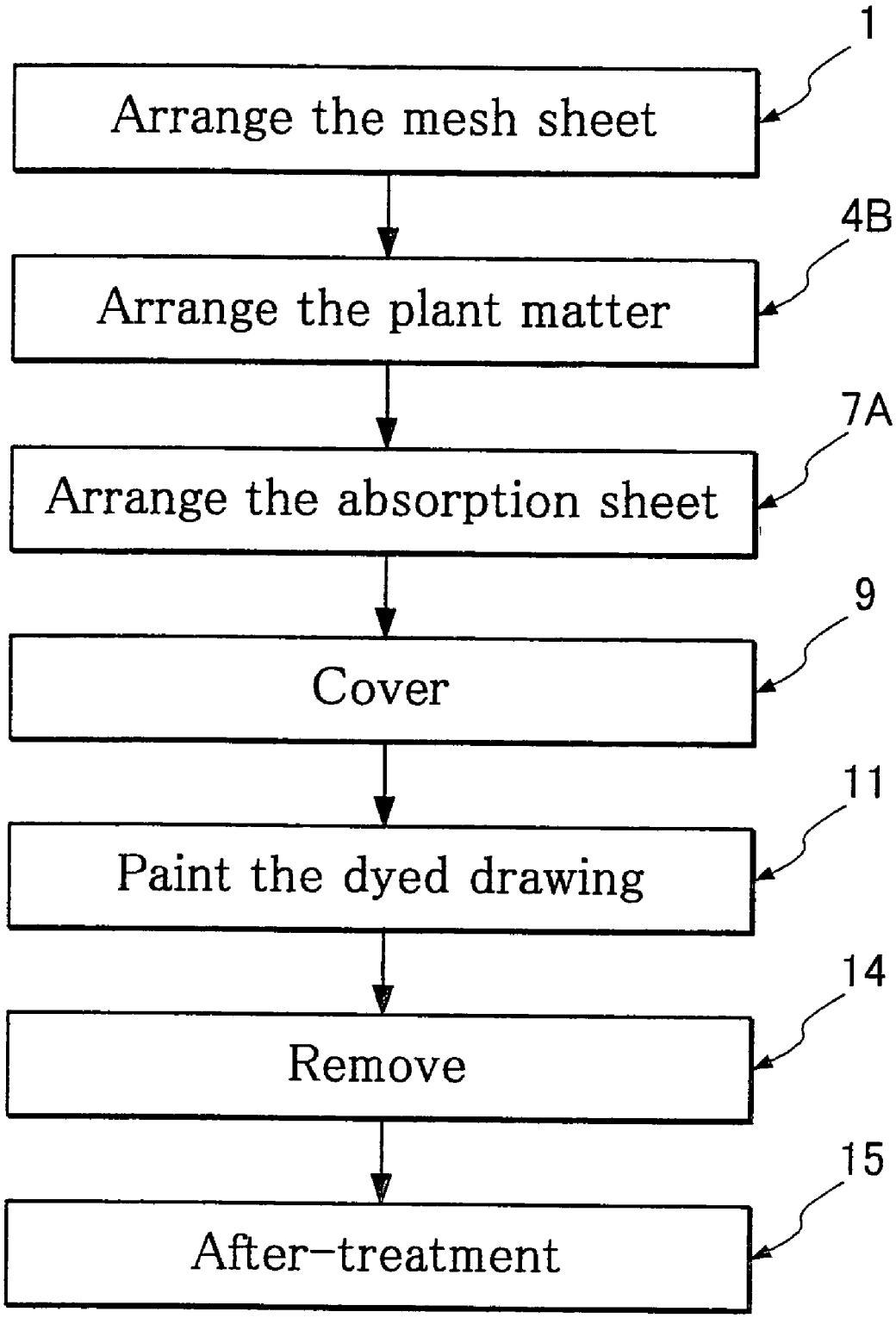
FIG. 27 is a flow diagram showing an eighth embodiment of the present invention.
Figure 28:
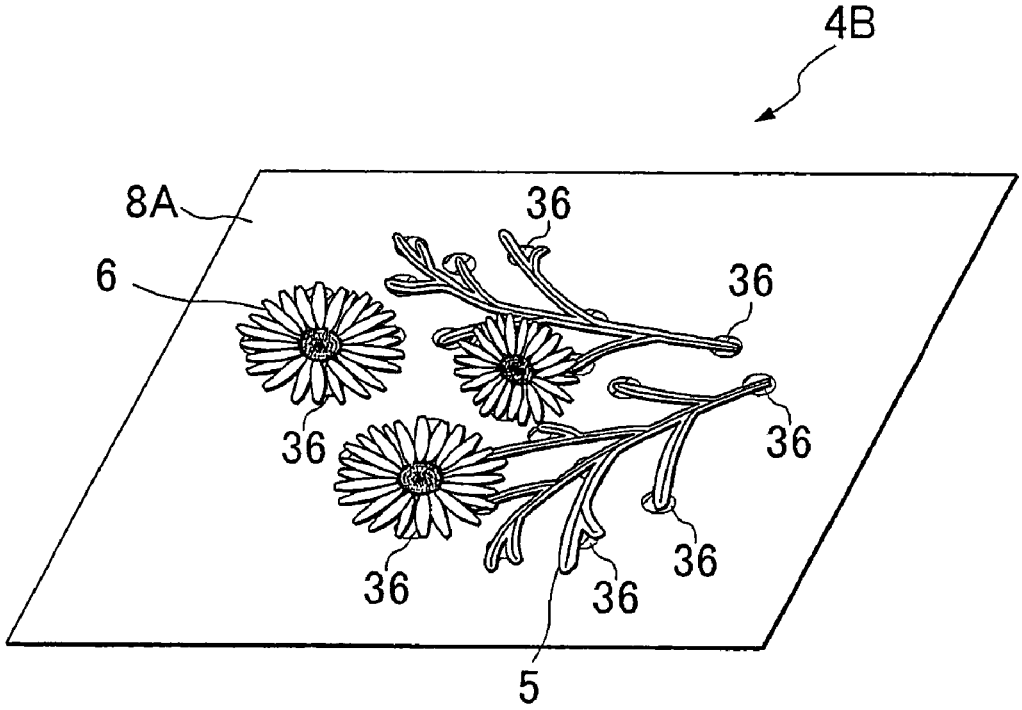
FIG. 28 is an examination view of a step for arranging plant matter.
Figure 29:
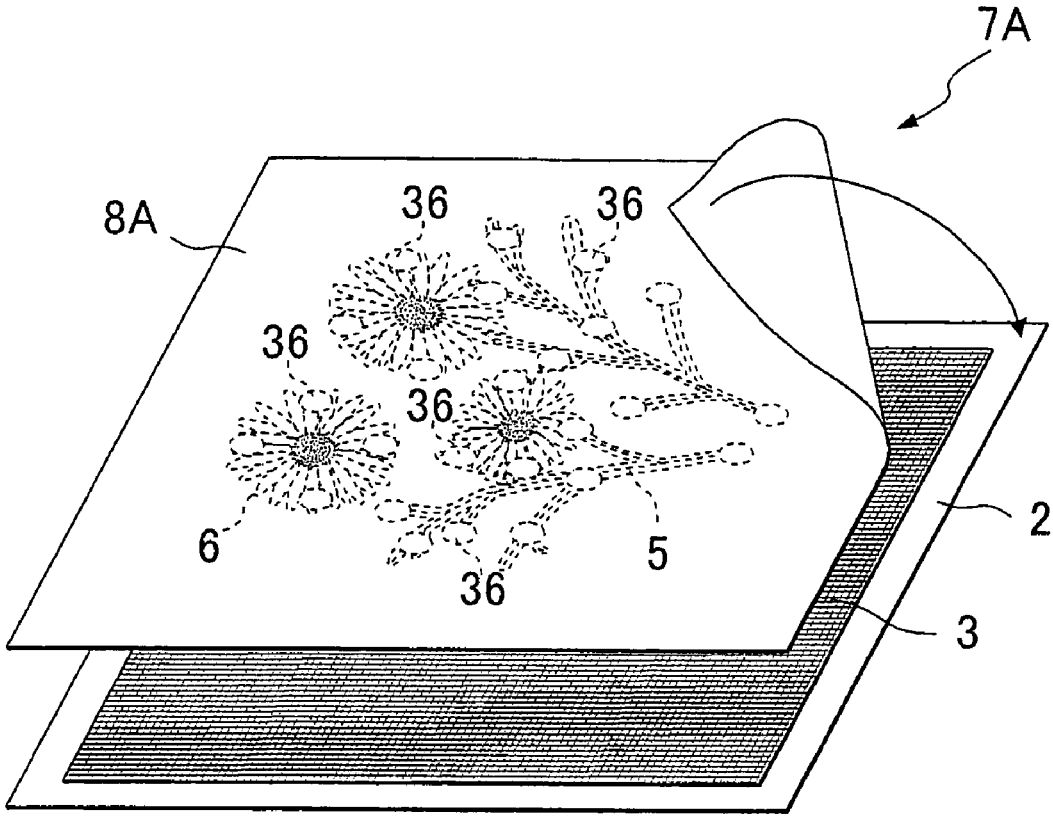
FIG. 29 is an examination view of a step for arranging a fixing sheet.
Figure 30:
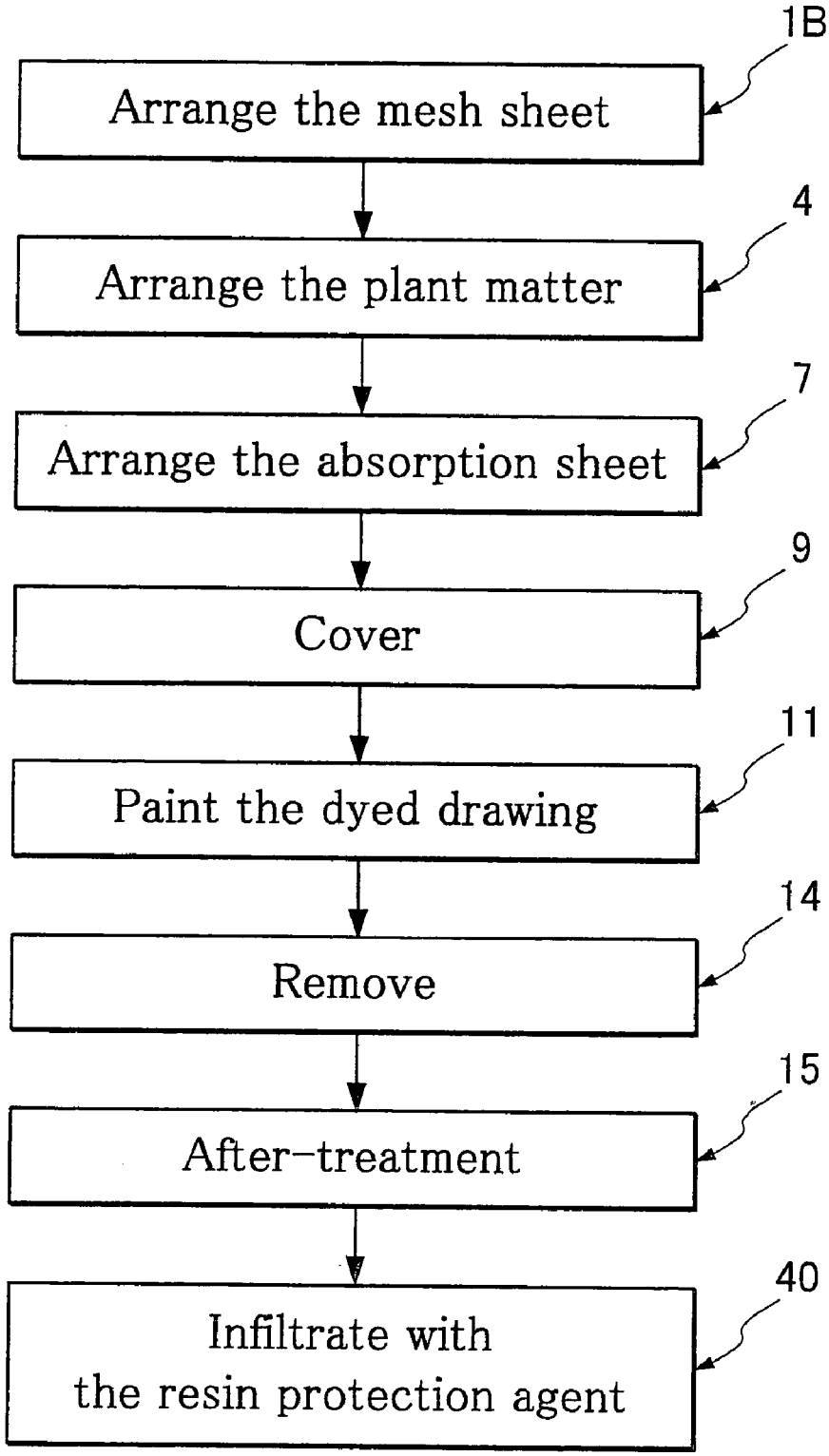
FIG. 30 is a flow diagram showing a ninth embodiment of the present invention.
Figure 31:
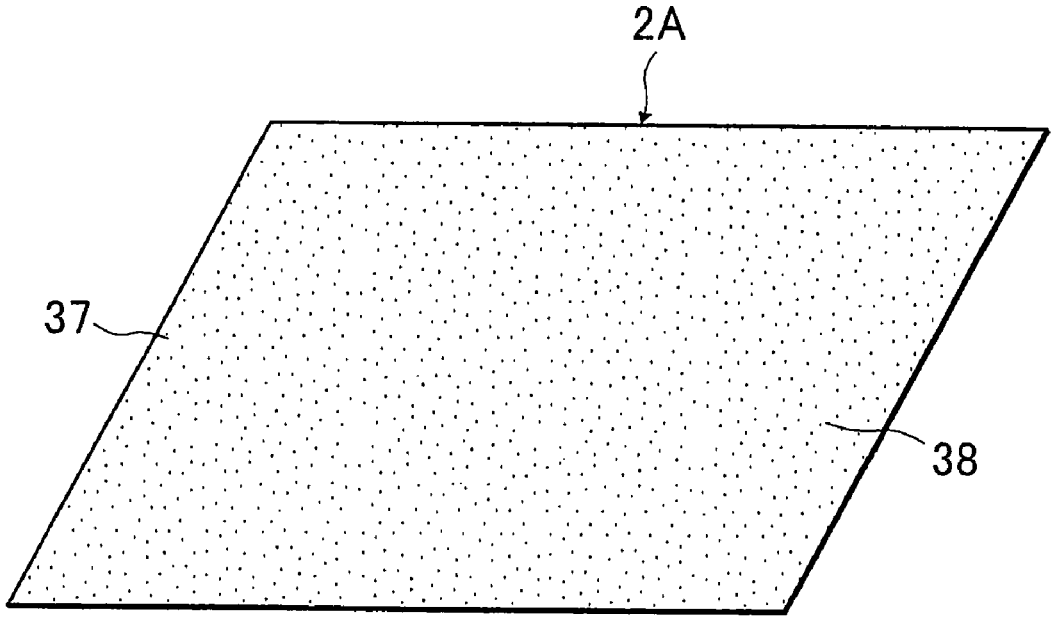
FIG. 31 is a perspective view of a canvas for a dyed drawing of plant matter.
Figure 32:
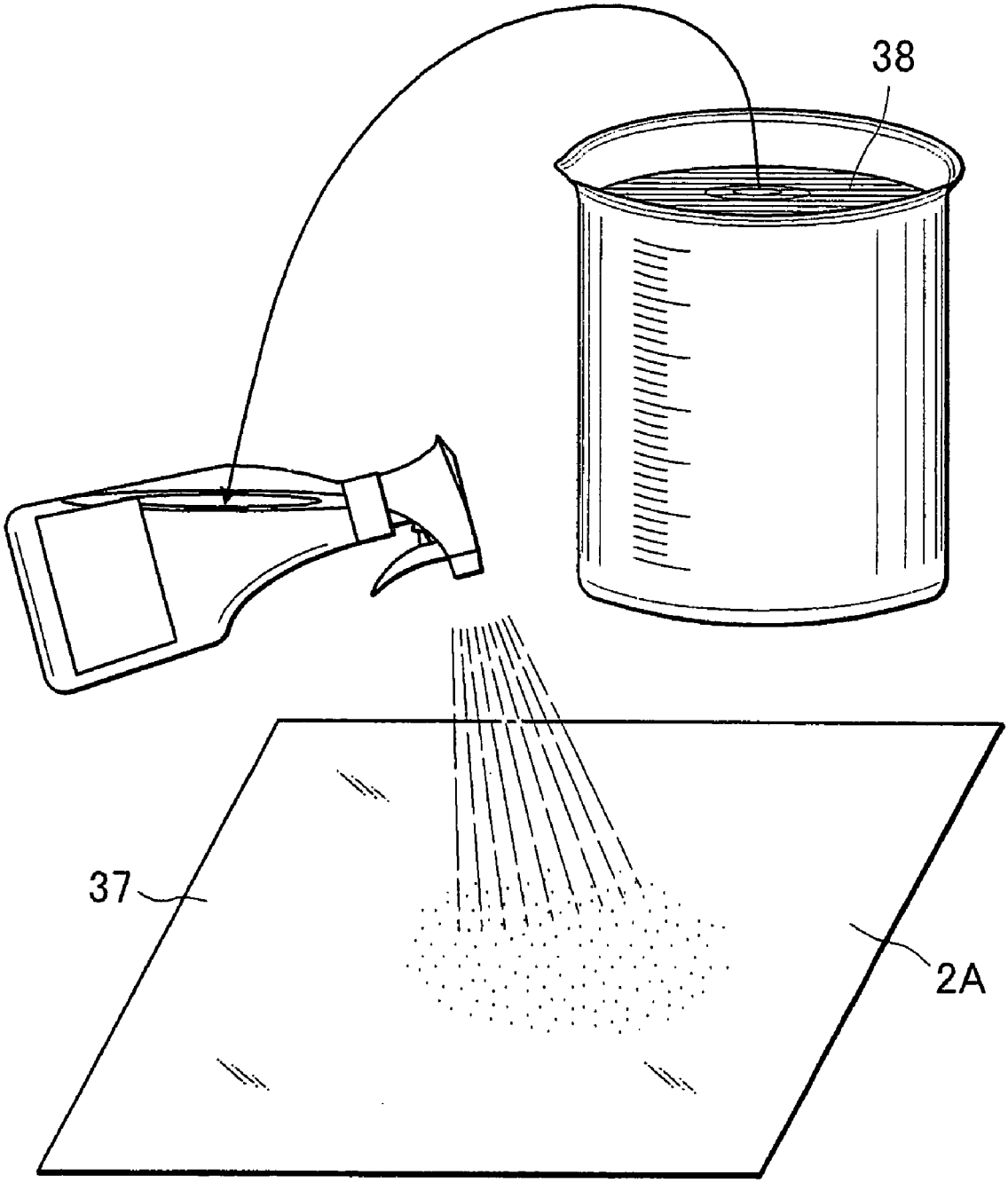
FIG. 32 is an examination view for impregnating with a pH setting solution.
Figure 33:
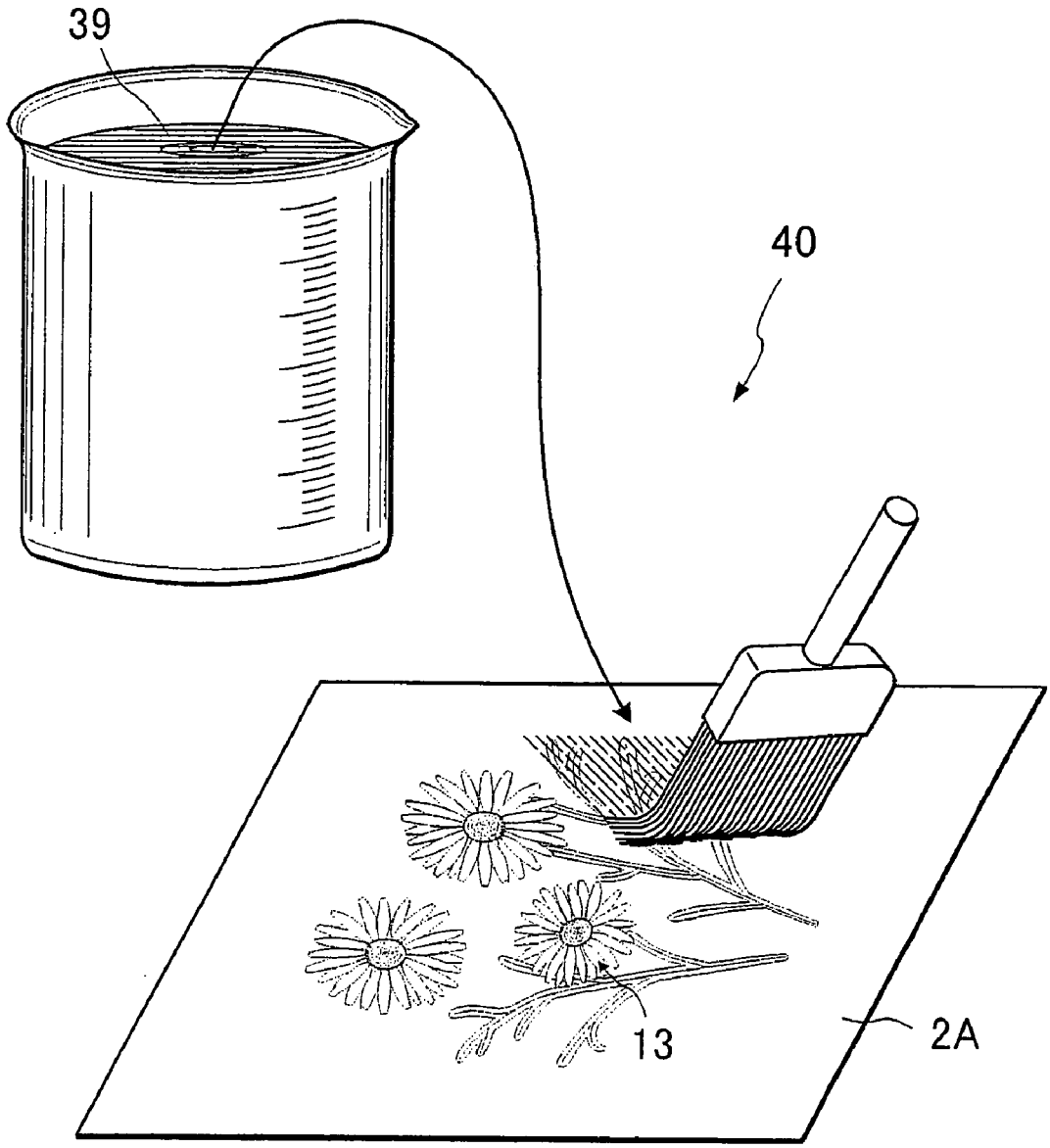
FIG. 33 is an examination view of a step for after-treatment.

An eighth embodiment of the present invention is shown in FIGS. 27–29. It is distinguished from the first embodiment in that the arrangement step 4 is replaced with step 4B and the arrangement step 7 is replaced with arrangement step 7A. In the arrangement step 4B for arrangement of the plant matter, the leaves 5 and flowers 6 are arranged fixedly on a fixing sheet 8A with or without water absorption capabilities. In the arrangement step 7A, the leaves 5 and flowers 6 arranged fixedly on the fixing sheet 8A are located at the upper surface of the mesh sheet 3 after the arrangement step 1 is carried out. A creation method of a dyed drawing of plant matter with the arrangement step 4B and the arrangement step 7A according to the eighth embodiment has similar advantages to that according to the first embodiment, where the leaves 5 and flowers 6 do not move, and the work of the dyed drawing can be carried out such that the leaves 5 and flowers 6 are arranged on the fixing sheet 8A in advance.

A ninth embodiment of the present invention is shown in FIGS. 30–33. It is distinguished from the first embodiment in that a canvas 2A is comprised of a canvas body 37 which is a drawing paper etc.; and a pH setting solution 38 which is either DL-malic acid, sodium DL-malic acid, phytic acid, citric acid or a combined solution with at least two kinds of the above-mentioned liquids, impregnates the canvas 2A so as to set the range of pH of 2.5 to 3.5, capable of keeping the pH constant over the long term.

The arrangement step 1 is replaced with step 1B which may be carried out in this embodiment. Also a step 40 for infiltrating with a resin protection agent 39 may be carried out. In the infiltrating step 40 as the after-treatment step, the resin protection agent 39 including polyester resin, acrylic resin, silicon resin, polyethylene resin or the like is infiltrated to at least part of dyed drawing 13 of the canvas 2A.

When a creation method of a dyed drawing of plant matter with such steps, the pigment can be drawn to the canvas 2A for the dyed drawing in a colorful state since the canvas 2A for the dyed drawing is set at the range of pH of 2.5 to 3.5.

In addition, anthocyan and flavone which are pigments of the plant matter and are colorful, and they are prevented from changing color or darkening due to oxidization and the like.

Figure 34:
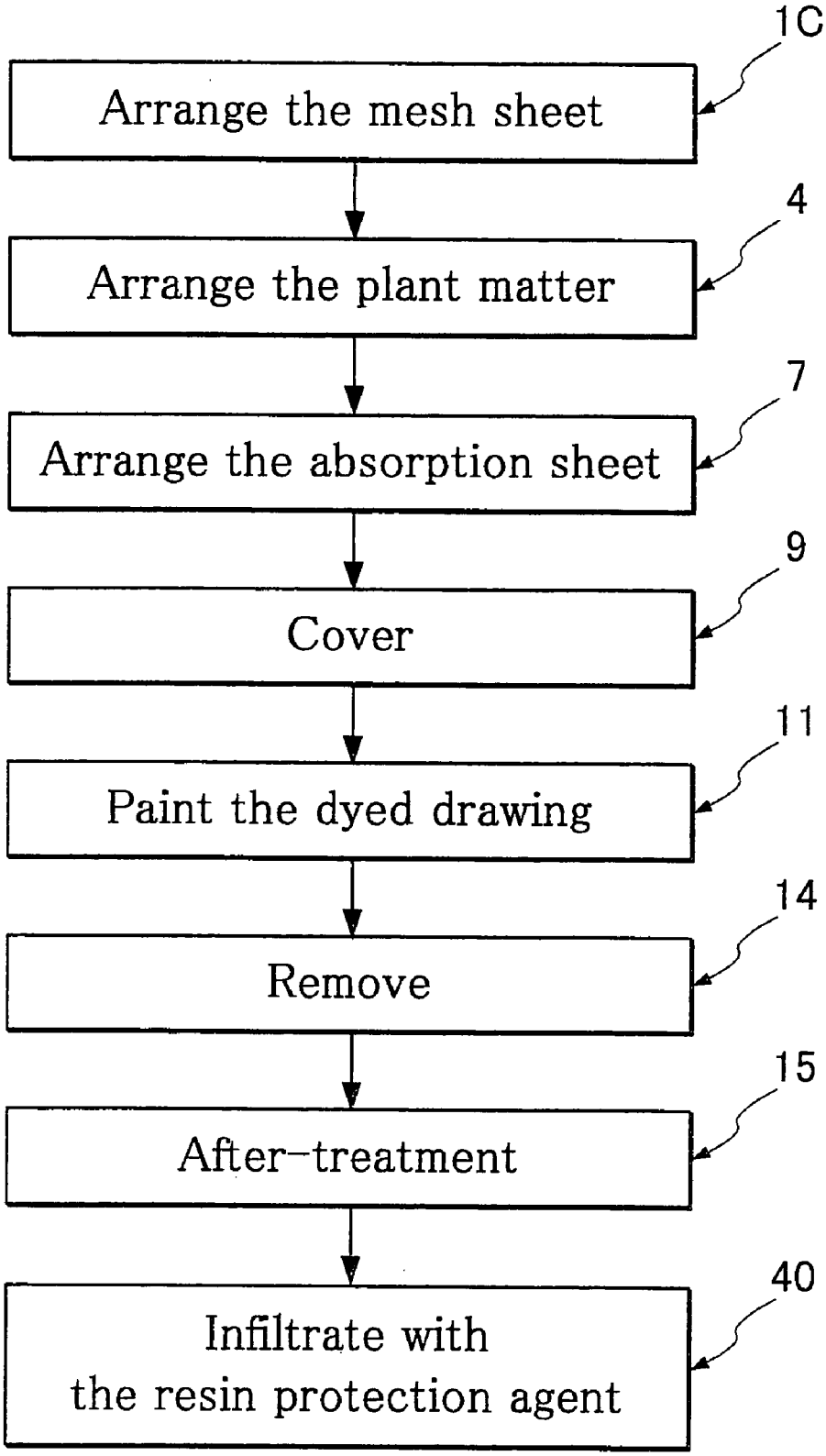
FIG. 34 is a flow diagram showing a tenth embodiment of the present invention.
Figure 35:
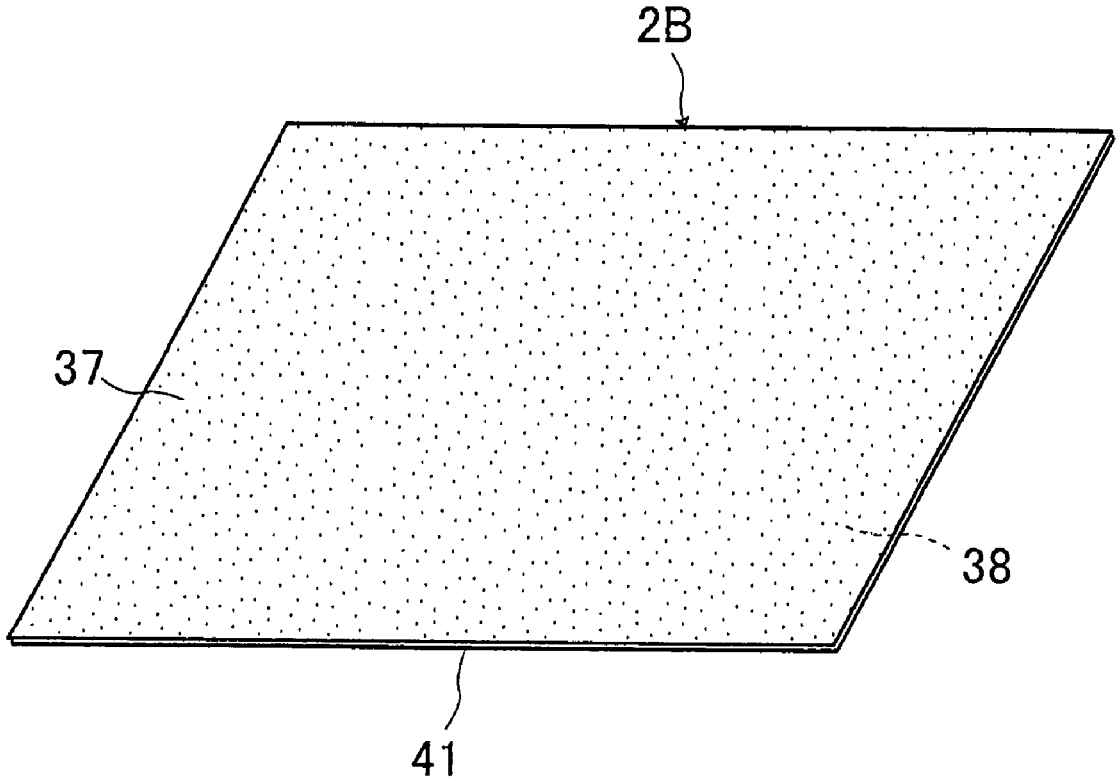
FIG. 35 is a perspective view of a canvas for a dyed drawing of plant matter.
Figure 36:
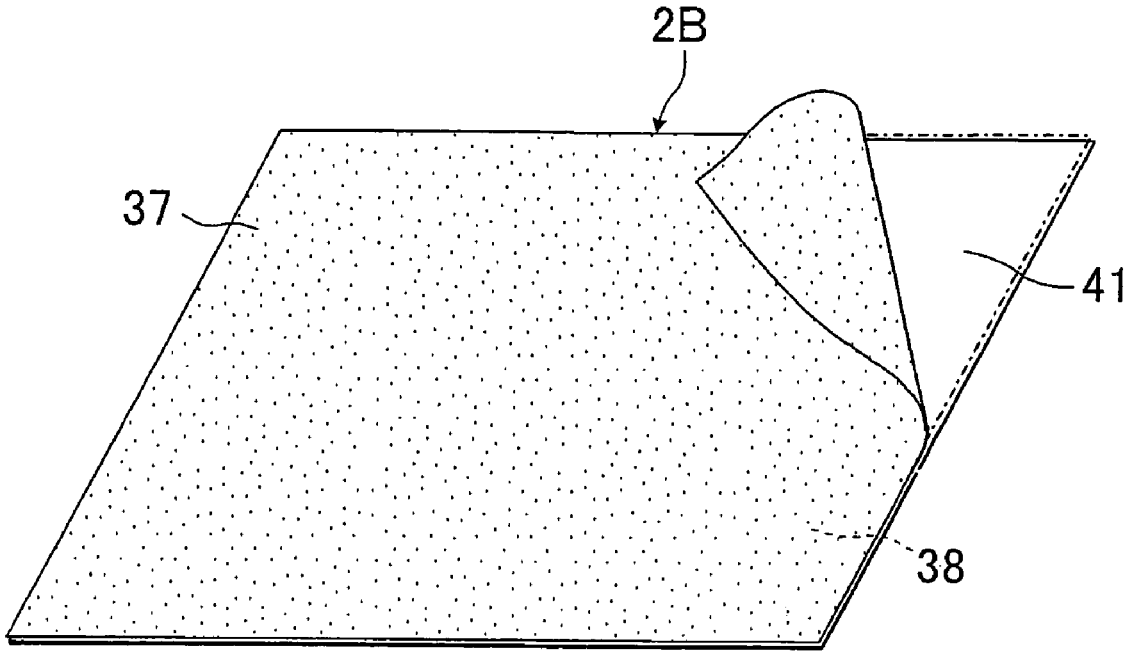
FIG. 36 is an examination view of a canvas for a dyed drawing of plant matter.

A tenth embodiment of the present invention is shown in FIGS. 34–36. It is distinguished from the ninth embodiment in that the canvas 2A for the dyed drawing is replaced with another canvas 2B including the canvas body 37 and a paper 41 which seldom absorbs water and which is adhered to the back surface of the canvas body 37. Then the canvas 2B is used at an arrangement step 1C. A creation method of a dyed drawing of plant matter with the arrangement step 1C according to the tenth embodiment has similar advantages to that according to the ninth embodiment.

In addition, instead of the paper 41, a synthetic resin sheet, an object formed in the shape of a sheet by applying the resin agent which gets rigid with UV, heat or the like may be adhered to the back of the canvas body 37.

Figure 37:
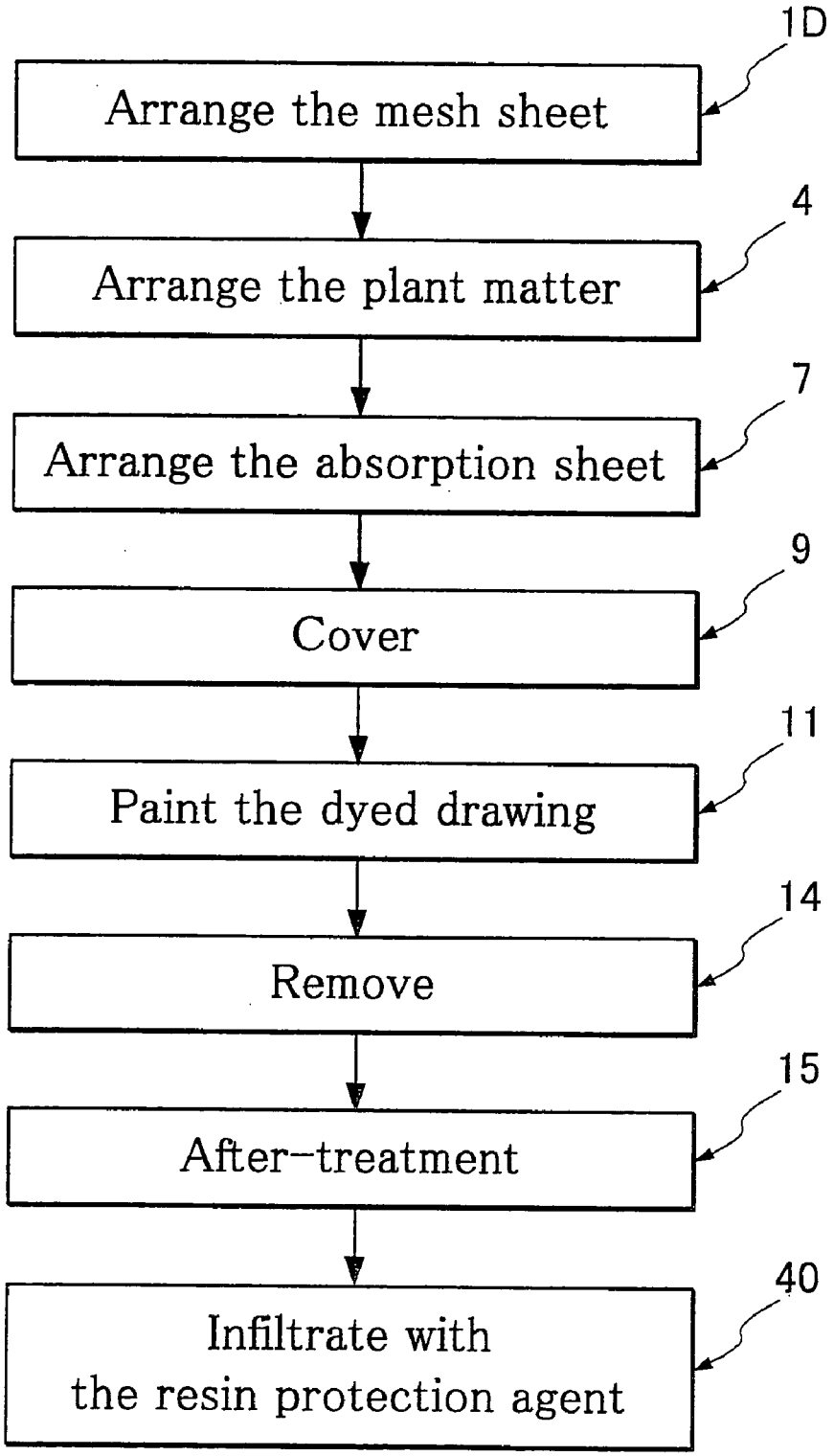
FIG. 37 is a flow diagram showing an eleventh embodiment of the present invention.
Figure 38:
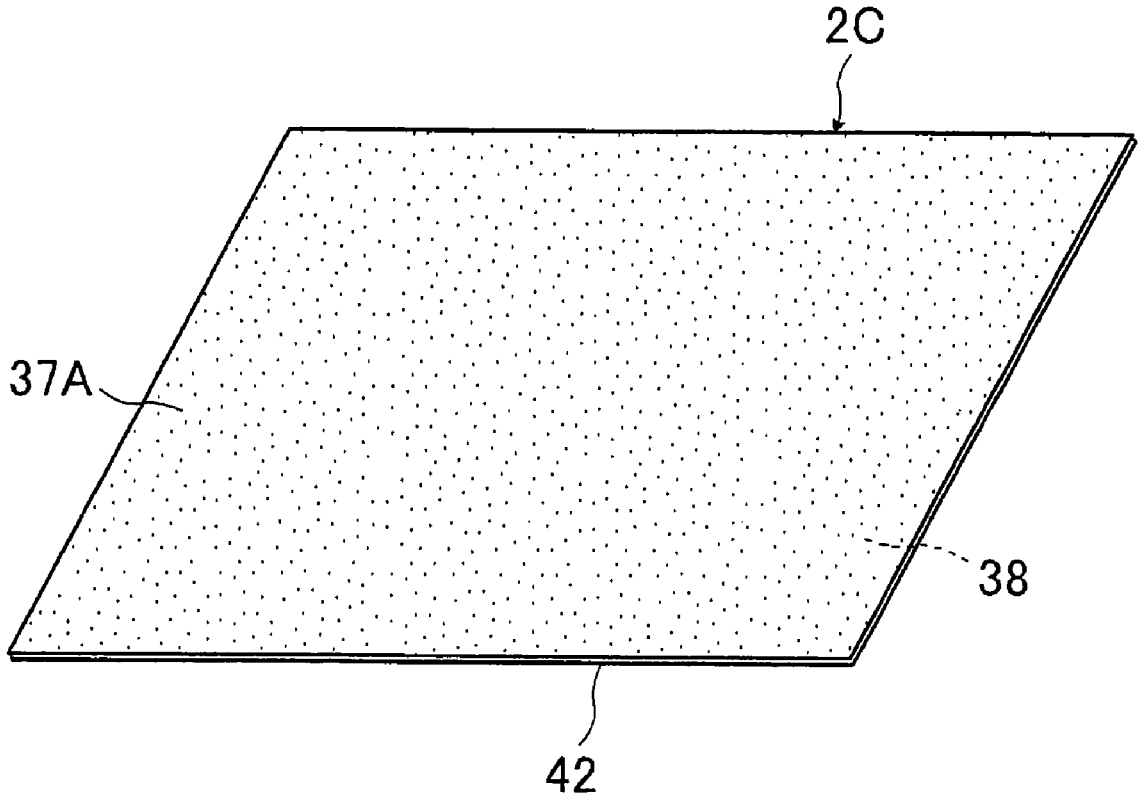
FIG. 38 is a perspective view of a canvas for a dyed drawing of plant matter.
Figure 39:
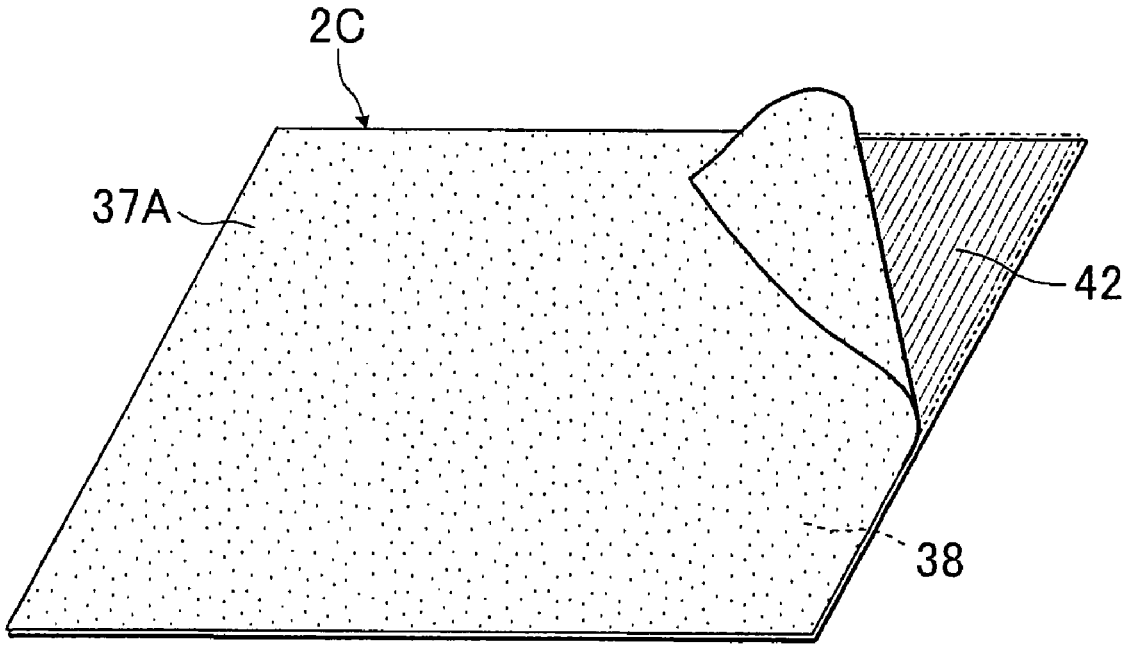
FIG. 39 is an examination view of a canvas for a dyed drawing of plant matter.

An eleventh embodiment of the present invention is shown in FIGS. 37–39. It is distinguished from the tenth embodiment in that the canvas 2B for the dyed drawing is replaced with another canvas 2C including the canvas body 37A and a paper 42 which seldom absorbs water and which is adhered to the back of a canvas body 37A for the dyed drawing and which can be a superabsorbent cloth, board, plaster board, unglazed body or the like, the cloth being used in this embodiment. Then the canvas 2C is used at an arrangement step 1D. A creation method of a dyed drawing of plant matter with the arrangement step 1D according to the eleventh embodiment has similar advantages to that according to the tenth embodiment.

Figure 40:
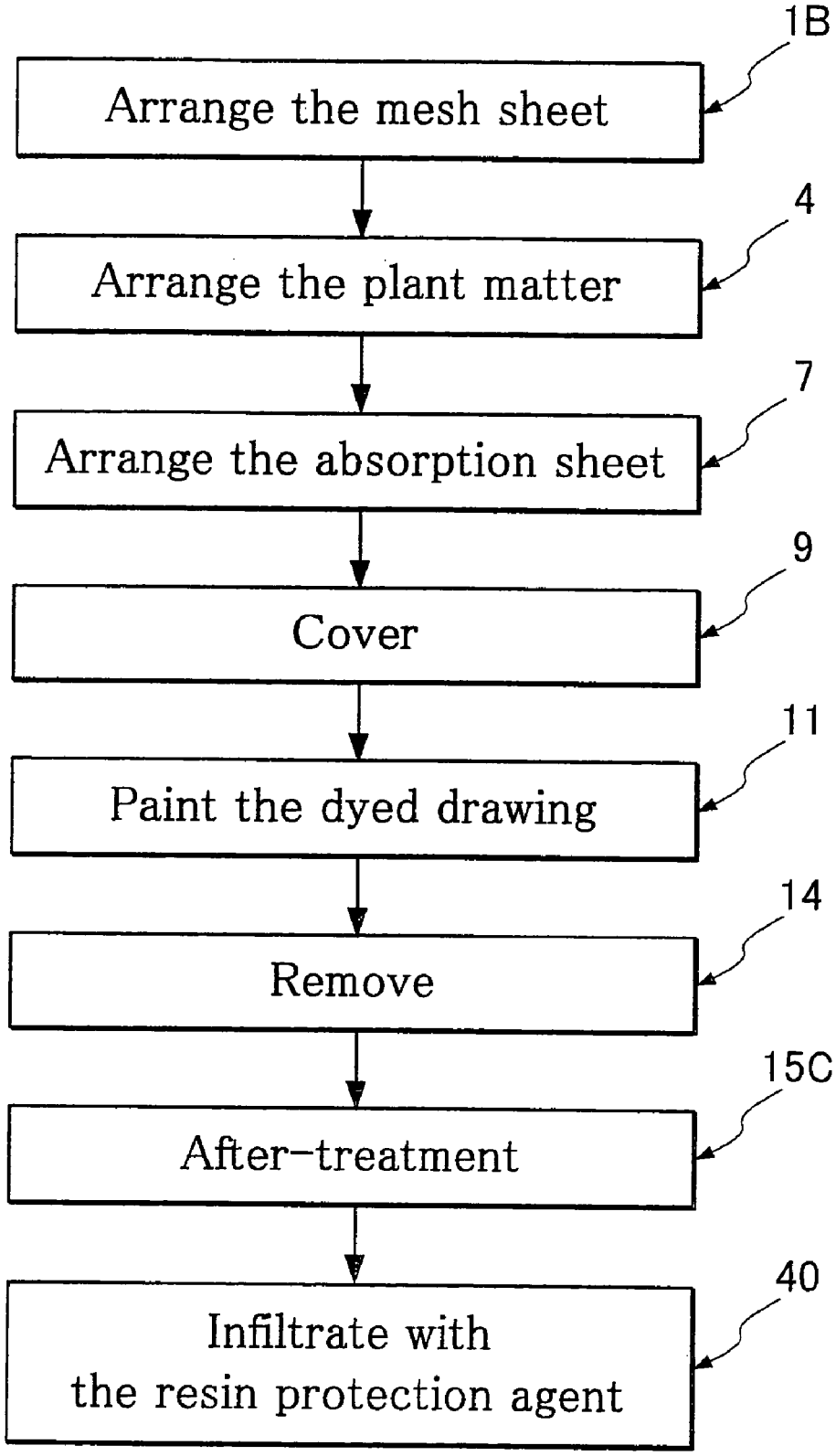
FIG. 40 is a flow diagram showing a twelfth embodiment of the present invention.
Figure 41:
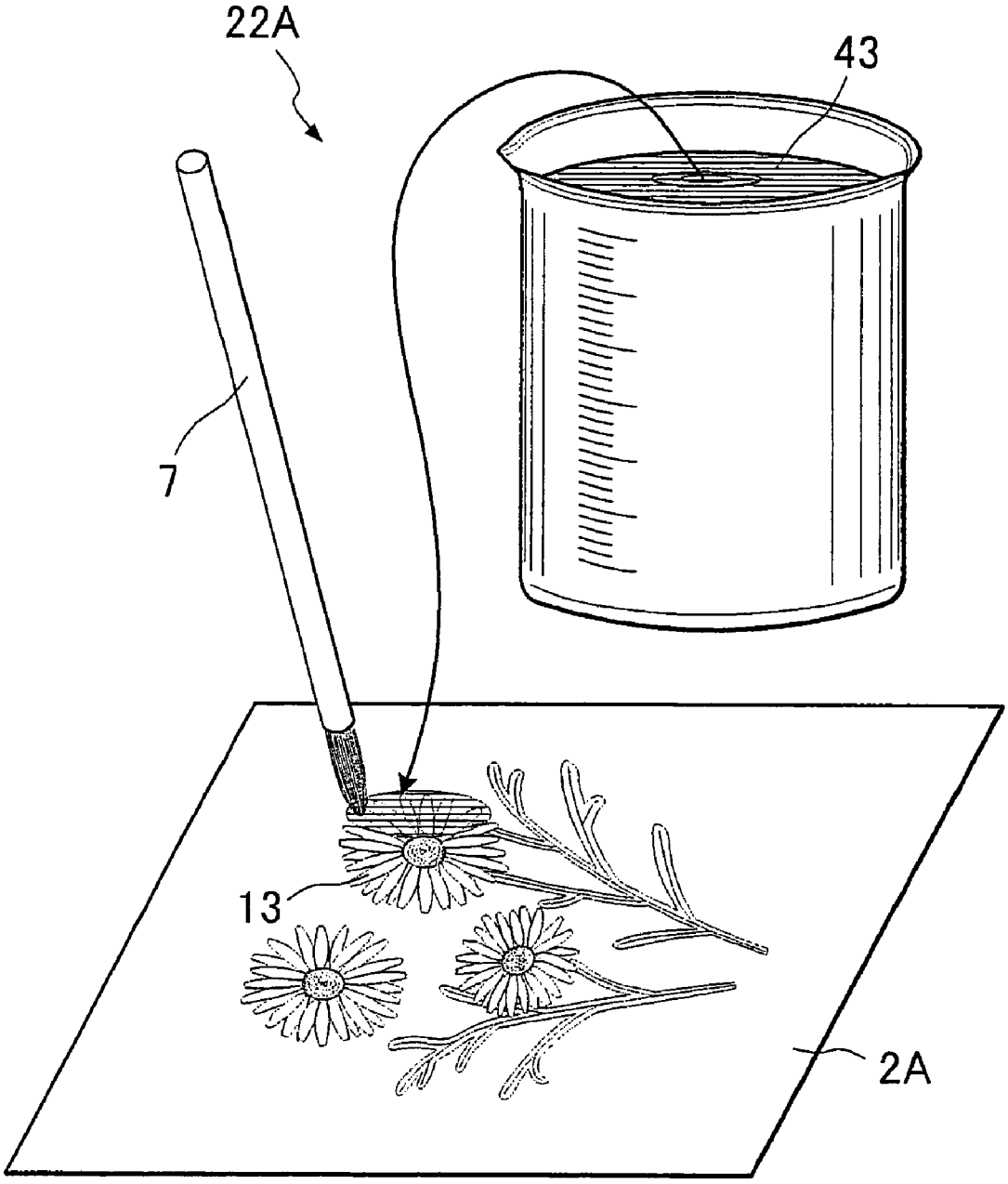
FIG. 41 is an examination view of a step for after-treatment.

A twelfth embodiment of the present invention is shown in FIGS. 40 and 41. It is distinguished from the ninth embodiment in having a step 22A for coloring. In the coloring step 22A, a solution 43 including baking soda, sodium carbonate and the like with acescence to alkalinity is applied in a part of the dyed drawing 13 with a brush 17 and the like, and the dyed drawing 13 can be colored in a natural color as much as possible. Then the coloring step 22A as the after-treatment step 15C is carried out. A creation method of a dyed drawing of plant matter with such step according to the twelfth embodiment has similar advantages to that according to the ninth embodiment.

Figure 42:
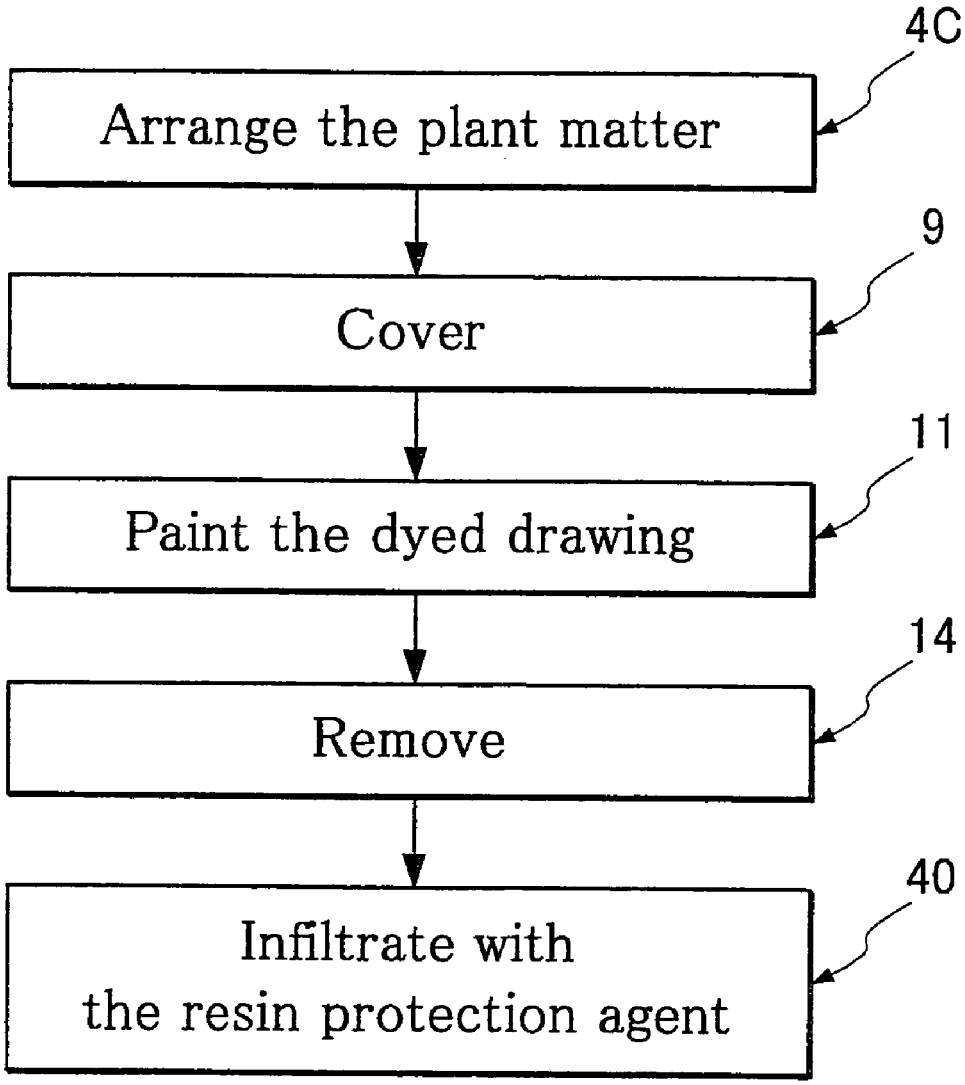
FIG. 42 is a flow diagram showing a thirteenth embodiment of the present invention.
Figure 43:
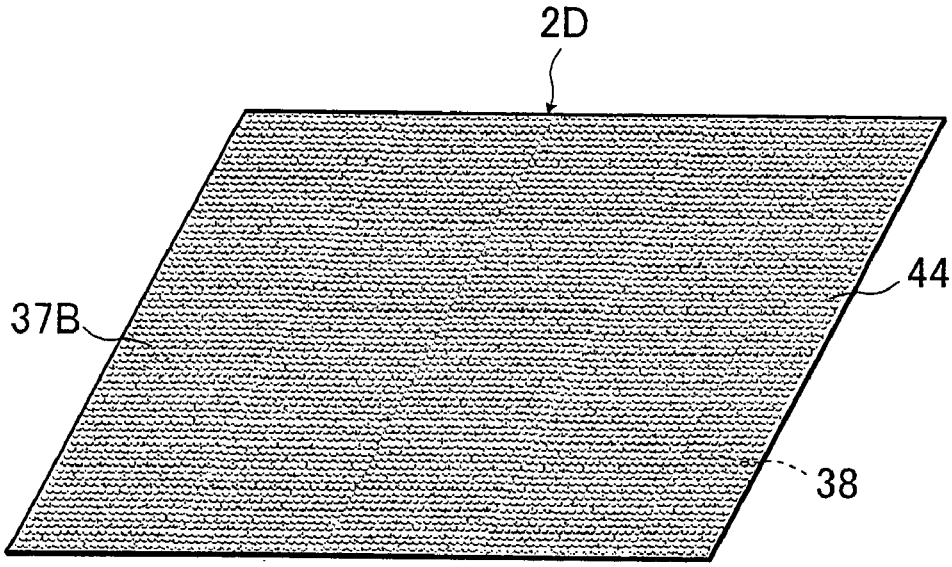
FIG. 43 is a perspective view of a canvas for a dyed drawing of plant matter.
Figure 44:
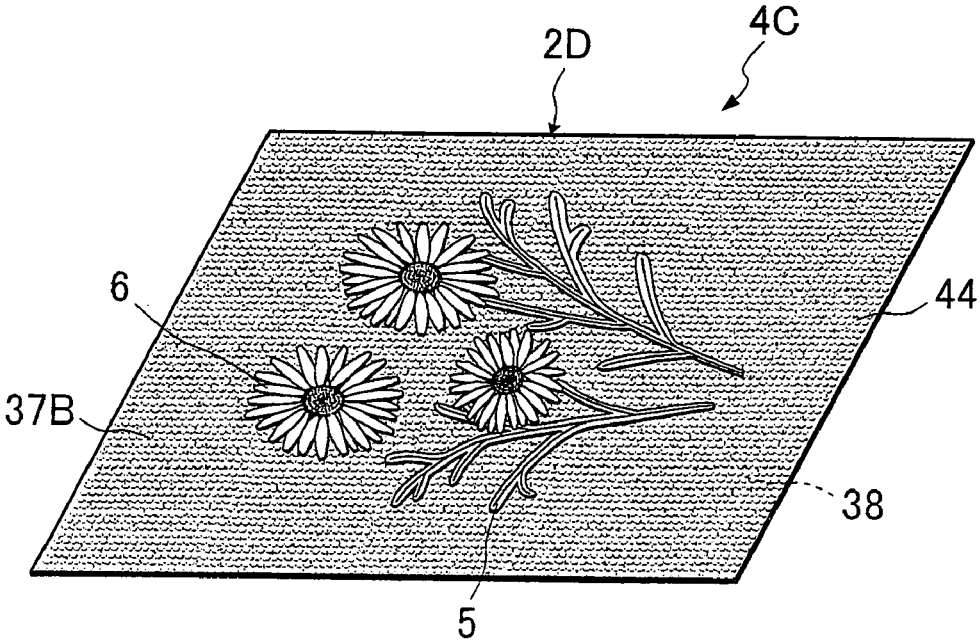
FIG. 44 is an examination view of a step for arranging plant matter.

A thirteenth embodiment of the present invention is shown in FIGS. 42–44. It is distinguished from the ninth embodiment in that the canvas 2A is replaced with canvas 2D including a canvas body 37B which is a superabsorbent paper cloth, board, plaster board, unglazed body or the like on which are formed tiny asperities on the surface thereof, the paper is used in this embodiment. Then after a step 4C for arranging the leaves 5 and flowers 6 on the upper surface of the dyed drawing of the canvas 2D, the covering step 9, drawing step 11, removing step 14 and infiltrating step 40 are carried out in order. A creation method of a dyed drawing of plant matter with such step according to the thirteenth embodiment has similar advantages to that according to the ninth embodiment.

Figure 45:
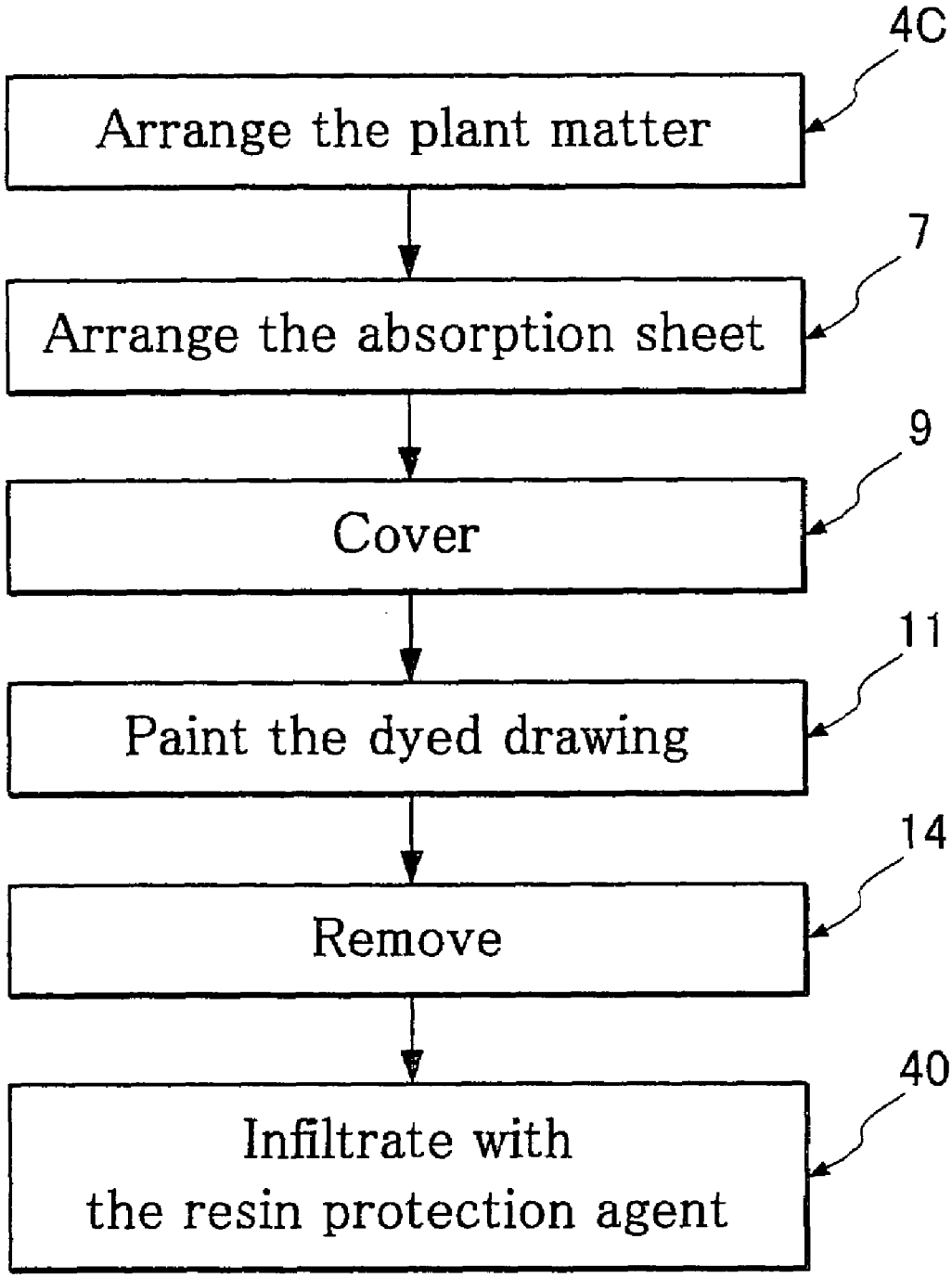
FIG. 45 is a flow diagram showing a fourteenth embodiment of the present invention.
Figure 46:
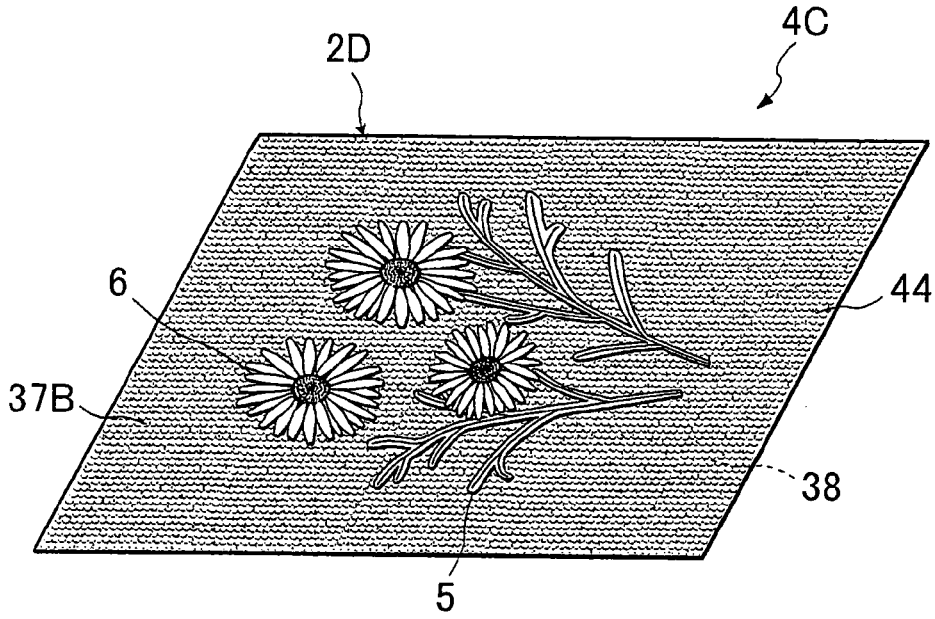
FIG. 46 is an examination view of a step for arranging plant matter.
Figure 47:
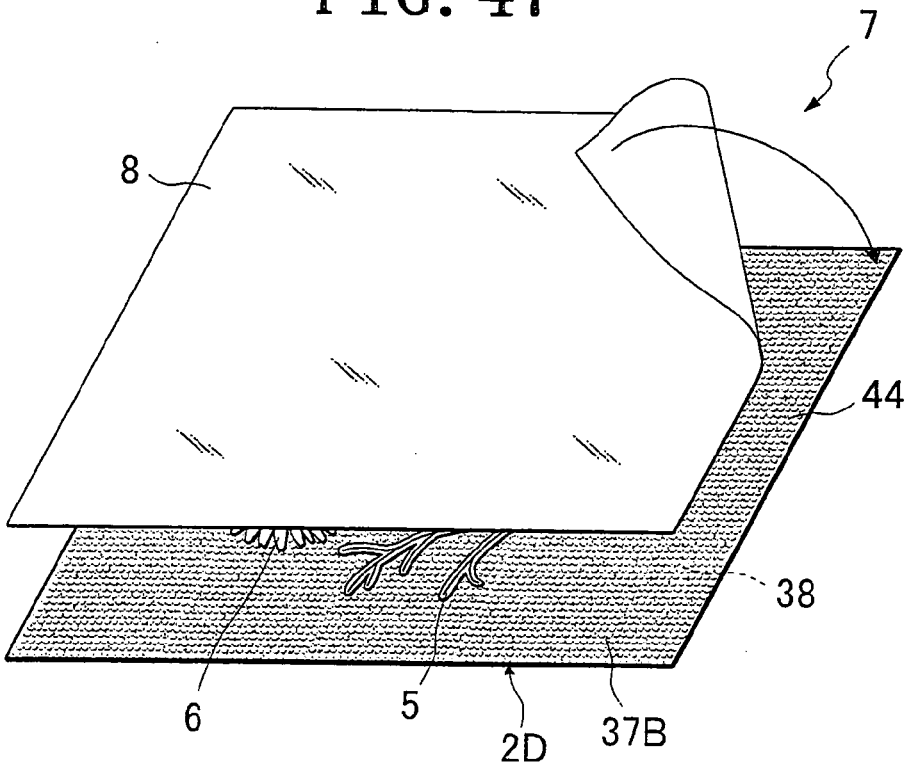
FIG. 47 is an examination view of a step for arranging an absorption sheet.

A fourteenth embodiment of the present invention is shown in FIGS. 45–47. It is distinguished from the thirteenth embodiment in that the step 7 for arranging the absorption sheet 8 which absorbs water from the upper surface of the plant matter is carried out between the arrangement step 4C and covering step 9. A creation method of a dyed drawing of plant matter with such step according to the fourteenth embodiment has similar advantages to that according to the thirteenth embodiment, and the absorption sheet 8 absorbs water such that a beautiful dyed drawing is drawn.

Figure 48:
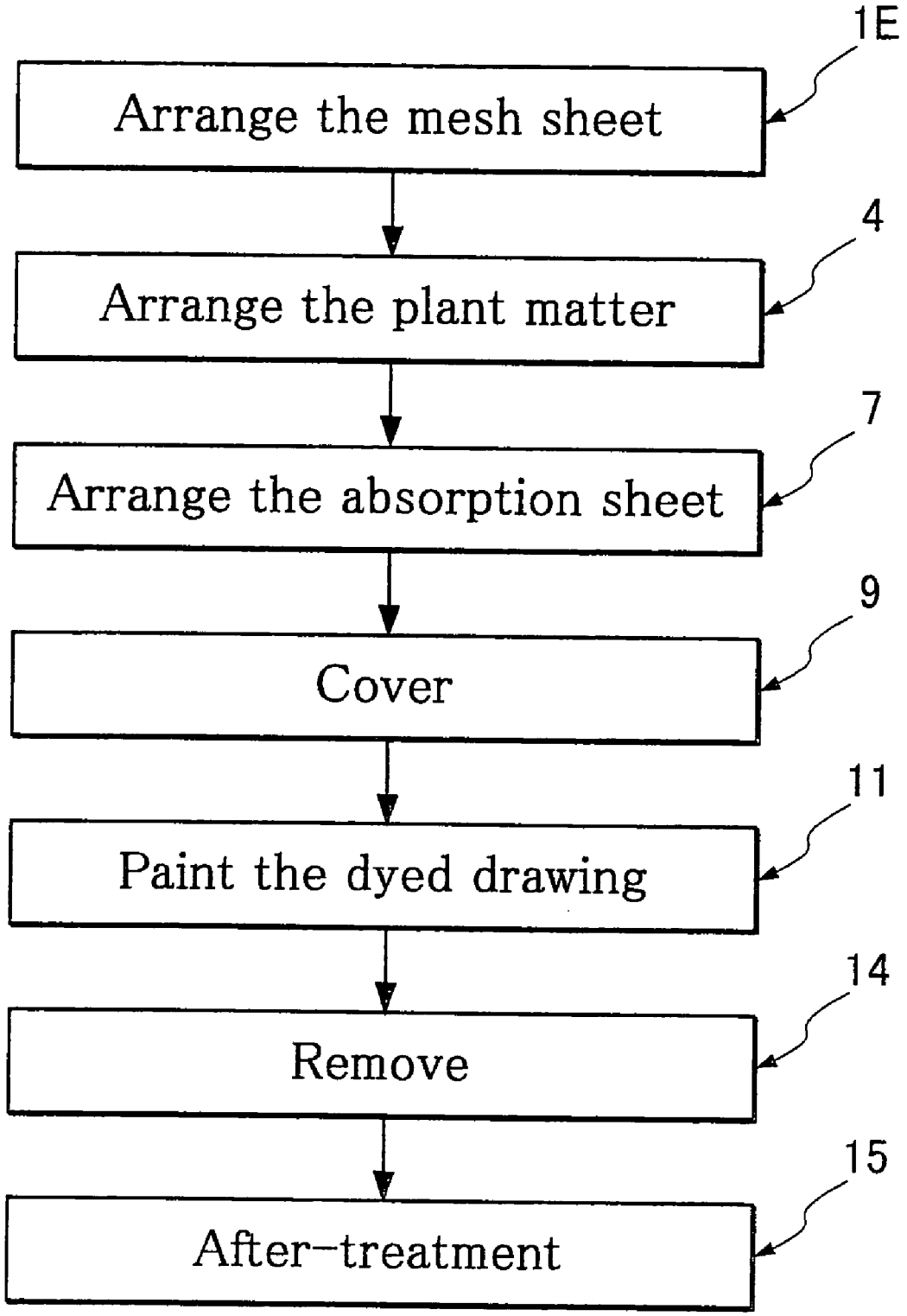
FIG. 48 is a flow diagram showing a tenth embodiment of the present invention.
Figure 49:
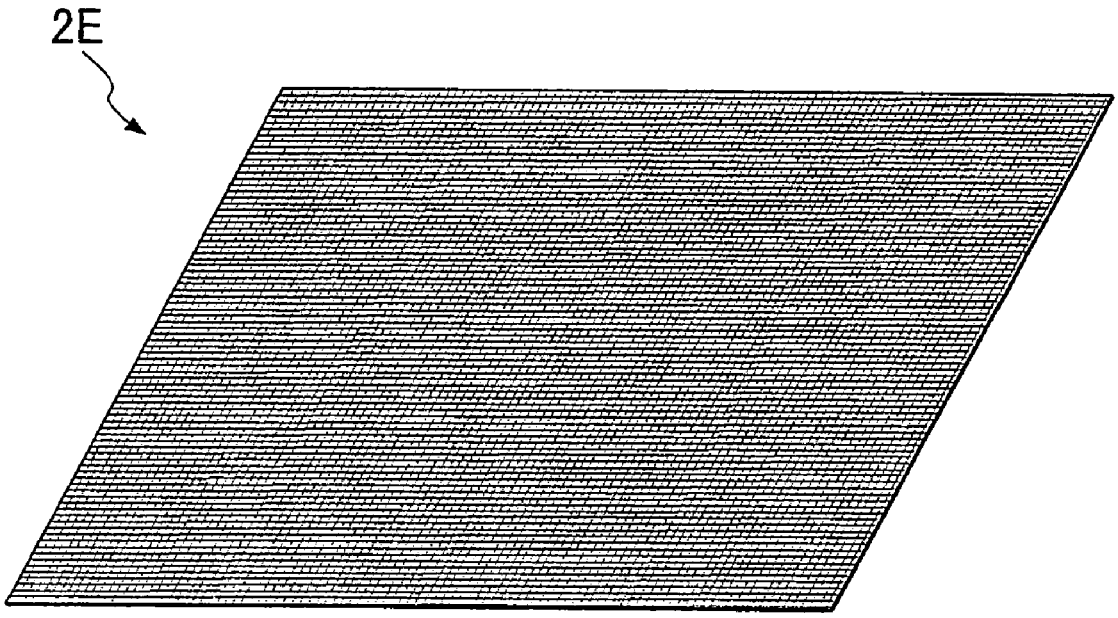
FIG. 49 is a perspective view of a canvas for a dyed drawing of plant matter.
Figure 50:
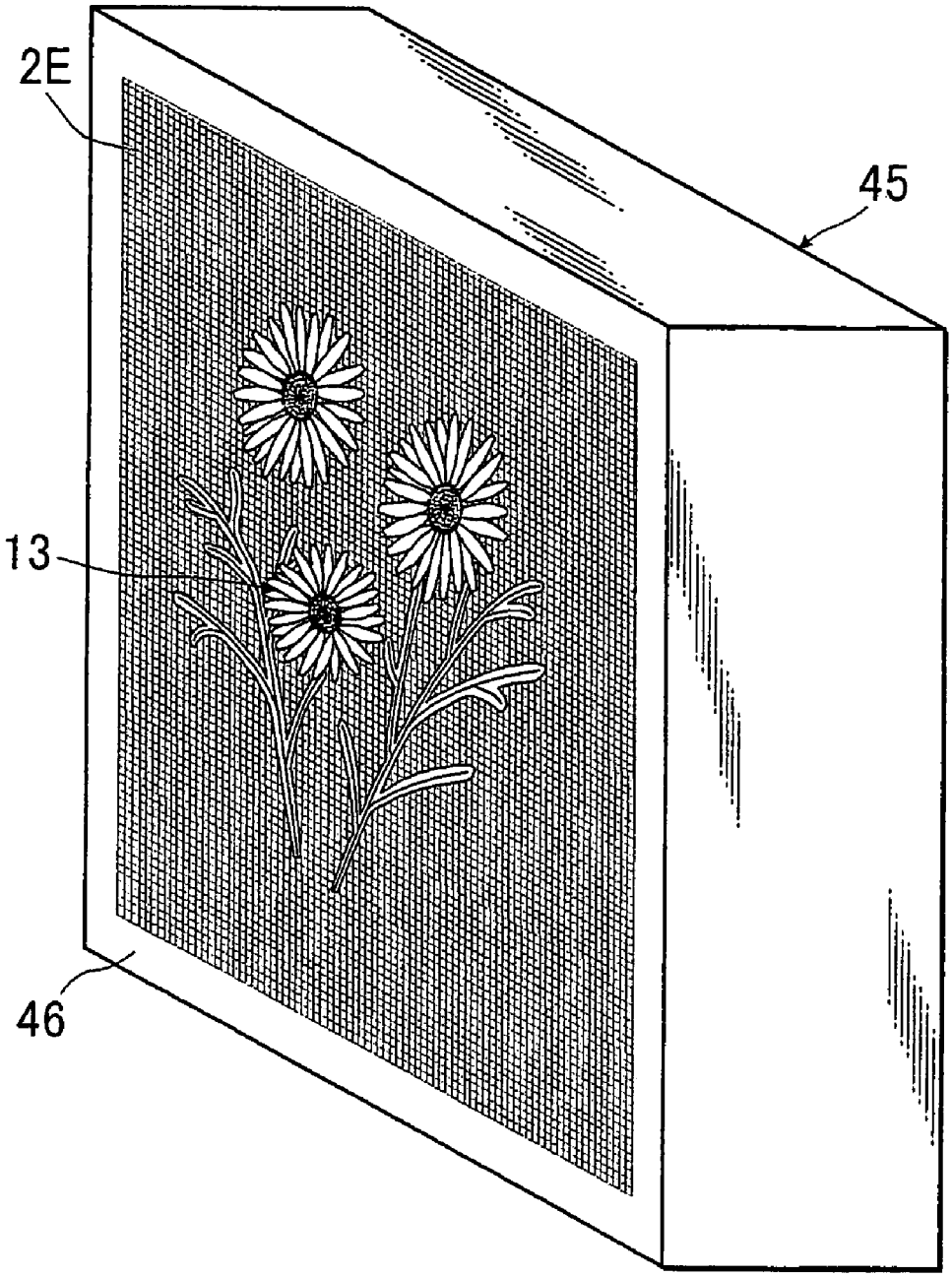
FIG. 50 is an examination view showing the way in which a dyed drawing of plant matter is attached.

A fifteenth embodiment of the present invention is shown in FIGS. 48–50. It is distinguished from the first embodiment in that the canvas 2 is replaced with canvas 2E with chemical fiber paper or chemical fiber cloth including rayon, nylon, and acryl etc. that it is easy to be stained by a dye and which doesn't contain water-soluble elements so as to affect the pH of the plant matter. Then an arrangement step 1E is carried out. A creation method of a dyed drawing of plant matter with such step according to the fifteenth embodiment has similar advantages to that according to the first embodiment, and the canvas 2E drawn with the dyed drawing 13 is adhered to the surface of a decoration body 45 which is formed in the shape of a flat surface or cubic shape with a transparent resin 46, including a transparent silicon resin, which does not affect pH of the plant matter so that the canvas 2E is under transparent material as much as possible so the object looks clean when immersed in water, and it is honed to be beautiful.

In addition, the silicon resin for adhering may be applied in the surface of the canvas 2E for the dyed drawing.

In the embodiment, the canvas 2E may be used as the canvas treated for anti-oxidization, canvas treated for acid, canvas treated for a fixing agent, canvas attached to the board at the back thereof, canvas processed to be formed with tiny asperities on the surface without the mesh sheet or canvas, which is cloth, paper or the like, which does not affect pH of the plant matter.

Moreover, in each of the embodiments in the present invention, when the back of the leaves 5 and the surface of the flowers 6 of the plant matter which are arranged at the upper surface of the mesh sheet or canvas for the dyed drawing are arranged, pigment can flow out efficiently from almost all of the plant matter.

Furthermore, in the embodiments of the present invention, the step 7 for arranging the thin absorption sheet 8 with water absorption capabilities including tissue paper, toilet paper, etc., which covers the upper surface of the plant matter after the arrangement step 4 is carried out and the step for covering the transparent or translucent synthetic resin sheet 10 on the upper surface of the water absorption sheet 8 after the arrangement step 7 is carried out are explained. Also the steps without the step 7 for arranging the absorption sheet may be carried out, and the step 9 for covering using the synthetic resin sheet other than the transparent or translucent synthetic resin sheet 10 may be carried out.

As set forth above, the advantages of the invention are as follows:

(1) A creation method of a dyed drawing of plant matter includes a step of arranging a mesh sheet on a surface part of a canvas for a dyed drawing which is drawn; arranging leaves and flowers of the plant matter on an upper surface of the mesh sheet after the mesh sheet arrangement step is carried out; covering the plant matter with one of a transparent and a translucent synthetic resin sheet after the arrangement step for the plant matter is carried out; creating the dyed drawing on the canvas for the dyed drawing, including pushing the leaves and flowers of the plant matter to the mesh sheet after pressing the synthetic resin sheet by one of a spatula and a roller, causing the outflow of pigments of the leaves and flowers, and adhering the pigment to the canvas after the covering step is carried out; and removing the mesh sheet, the leaves and flowers of the plant matter and the synthetic resin sheet which are located on the surface of the canvas for the dyed drawing after the creating step is carried out. Therefore, the pigment can flow out after the leaves and flowers are pressed to the mesh sheet by the spatula and scratched.

Therefore, the pigment can flow out efficiently, and the pigment can be adhered to the object for the dyed drawing.

(2) As discussed above, the absorption sheet and synthetic resin sheet cover the upper part of the leaves and flowers and are pressed by the spatula. Therefore, the movement of the leaves and flowers can be prevented efficiently by moving the synthetic resin sheet during the pressing of the spatula, and the pigment of the shape of the leaves and flowers can be adhered and transferred to the object for the dyed drawing.

(3) As discussed above, even though the leaves and flowers of the plant matter are separated by pressing the spatula, the leaves and flowers can be removed with the mesh sheet at the attached state when the mesh sheet is taken away.

Therefore, there is prevention of the adherence of the leaves and flowers to the object of the dyed drawing, thus, the beautiful dyed drawing can be created.

(4) When the absorption sheet is used, it absorbs the extra pigment which flows out of the leaves and flowers of the plant matter and the fading of color can be prevented. In addition, the absorption sheet absorbs water so that the outline of the leaves and flowers is clear, the pressure power of the spatula can be controlled, and the beautiful dyed drawing can be created.

(5) The dyed drawing that is drawn in the canvas is cleaned up and can be prevented to change color in the after-treatment step.

What is claimed is:

1. A method for creating a dyed drawing of plant matter comprising:

arranging a mesh sheet on a substrate;

arranging plant matter comprising at least one leaf or one flower on an upper surface of said mesh sheet;

covering said plant matter with a transparent or a translucent synthetic resin sheet;

pressing said synthetic resin sheet with a device so as to cause said plant matter to be pushed against said mesh sheet and so as to cause pigment of said plant matter to flow out of said plant matter and adhere to said substrate; and removing said mesh sheet, said plant matter, and said synthetic resin sheet from said substrate, wherein said substrate canvas comprises: canvas; drawing paper; cotton or other cloth; plaster or other board; an unglazed body with asperities on a surface thereof; or a chemical fiber paper or a chemical fiber cloth excluding any water-soluble element which affects the pH of said plant matter; and said substrate further comprises a pH setting solution comprising DL-malic acid, sodium DL-malic acid, phytic acid, citric acid or a combination thereof which impregnate the substrate so as to set the range of pH to 2.5 to 3.5.

2. A method for creating a dyed drawing of plant matter comprising:

arranging a mesh sheet on a substrate;

arranging plant matter comprising at least one leaf or one flower on an upper surface of said mesh sheet;

covering said plant matter with a transparent or a translucent synthetic resin sheet;

pressing said synthetic resin sheet with a device so as to cause said plant matter to be pushed against said mesh sheet and so as to cause pigment of said plant matter to flow out of said plant matter and adhere to said substrate; and removing said mesh sheet, said plant matter, and said synthetic resin sheet from said substrate, wherein said substrate comprises: canvas; drawing paper; cotton or other cloth; plaster or other board; an unglazed body with asperities on a surface thereof; or a chemical fiber paper or a chemical fiber clothe excluding any water-soluble element which affects the pH of said plant matter;

said substrate further comprises a filtration protection sheet comprising a paper or a synthetic resin sheet on a back surface of said substrate; and said substrate further comprises a pH setting solution comprising DL-malic acid, sodium DL-malic acid, phytic acid, citric acid or a combination thereof which impregnates said substrate so as to set the range of pH to 2.5 to 3.5.

3. A method for creating a dyed drawing of plant matter comprising:

arranging a mesh sheet on a substrate said substrate comprising: canvas; drawing paper; cotton or other cloth; plaster or other board; an unglazed body with asperities on a surface thereof; or a chemical fiber paper or a chemical fiber cloth excluding any water-soluble element which affects the pH of said plant matter;

arranging plant matter comprising at least one leaf or one flower on an upper surface of said mesh sheet;

covering said plant matter with a transparent or a translucent synthetic resin sheet;

pressing said synthetic resin sheet with a device so as to cause said plant matter to be pushed against said mesh sheet and so as to cause pigment from said plant matter to flow out of said plant matter and adhere to said substrate;

removing said mesh sheet, said plant matter, and said synthetic resin sheet from said substrate; and after-treating said dyed drawing to thereby prevent change of color, wherein said after-treating comprises infiltrating a surface of said dyed drawing with a resin protection agent, said resin protection agent comprising polyester resin, acrylic resin, silicon resin or polyethylene resin.

4. A method for creating a dyed drawing of plant matter comprising:

arranging a mesh sheet on a substrate, said substrate comprising: canvas; drawing paper; cotton or other cloth; plaster or other board; an unglazed body with asperities on a surface thereof; or a chemical fiber paper or a chemical fiber cloth excluding any water-soluble element which affects the pH of said plant matter;

arranging plant matter comprising at least one leaf or one flower on an upper surface of said mesh sheet;

covering said plant matter with a transparent or a translucent synthetic resin sheet;

pressing said synthetic resin sheet with a device so as to cause said plant matter to be pushed against said mesh sheet and so as to cause pigment from said plant matter to flow out of said plant matter and adhere to said substrate;

removing said mesh sheet, said plant matter, and said synthetic resin sheet from said substrate; and after-treating said dyed drawing to thereby prevent change of color, wherein said after-treating comprises applying an acid solution or an alkali solution to said dyed drawing on said substrate with a brush.

5. A method for creating a dyed drawing of plant matter comprising:

arranging a mesh sheet on a substrate, said substrate comprising: canvas; drawing paper; cotton or other cloth; plaster or other board; an unglazed body with asperities on a surface thereof; or a chemical fiber paper or a chemical fiber cloth excluding any water-soluble element which affects the pH of said plant matter;

arranging plant matter comprising at least one leaf or one flower on an upper surface of said mesh sheet;

covering said plant matter with a transparent or a translucent synthetic resin sheet;

pressing said synthetic resin sheet with a device so as to cause said plant matter to be pushed against said mesh sheet and so as to cause pigment from said plant matter to flow out of said plant matter and adhere to said substrate;

removing said mesh sheet, said plant matter, and said synthetic resin sheet from said substrate; and after-treating said dyed drawing to thereby prevent change of color, wherein said after-treating comprises applying a fixing solution to fix said pigment to said substrate.

6. A method for creating a dyed drawing of plant matter comprising:

arranging a mesh sheet on a substrate, said substrate comprising: canvas; drawing paper; cotton or other cloth; plaster or other board; an unglazed body with asperities on a surface thereof; or a chemical fiber paper or a chemical fiber cloth excluding any water-soluble element which affects the pH of said plant matter;

arranging plant matter comprising at least one leaf or one flower on an upper surface of said mesh sheet;

covering said plant matter with a transparent or a translucent synthetic resin sheet;

pressing said synthetic resin sheet with a device so as to cause said plant matter to be pushed against said mesh sheet and so as to cause pigment from said plant matter to flow out of said plant matter and adhere to said substrate;

removing said mesh sheet, said plant matter, and said synthetic resin sheet from said substrate; and after-treating said dyed drawing to thereby prevent change of color, wherein said after-treating comprises:

applying an acid solution or an alkali solution to said dyed drawing on said substrate with a brush; and applying a fixing solution to fix said pigment to said substrate.

7. A method for creating a dyed drawing of plant matter according to one of claims 4–6, wherein said after-treating further comprises infiltrating a surface of said dyed drawing with a resin protection agent, said resin protection agent comprising polyester resin, acrylic resin, silicon resin or polyethylene resin.

8. A method for creating a dyed drawing of plant matter according to claim 7, wherein said device comprises a roller.

9. A method for creating a dyed drawing of plant matter according to one of claims 3–6, wherein said device comprises a roller.

10. A method for creating a dyed drawing of plant matter according to one of claims 1, 2, and 3–6, wherein said cloth comprises a super absorbent cloth.

11. A method for creating a dyed drawing of plant matter according to one of claims 1, 2, and 3–6, wherein said chemical fiber cloth comprises rayon, mylon or acryl.

* * * * *